US009051813B2

(12) United States Patent
Howard et al.

(10) Patent No.: US 9,051,813 B2
(45) Date of Patent: Jun. 9, 2015

(54) WELL TREATMENT APPARATUS, SYSTEM, AND METHOD

(71) Applicant: Pioneer Natural Resources USA, Inc., Irving, TX (US)

(72) Inventors: Dustin Howard, Vici, OK (US); Phillip Mandrell, Weston, CO (US); Marty Stromquist, Calgary (CA)

(73) Assignee: Pioneer Natural Resources USA, Inc., Irving, TX (US)

( * ) Notice: Subject to any disclaimer, the term of this patent is extended or adjusted under 35 U.S.C. 154(b) by 0 days.

(21) Appl. No.: 13/828,768

(22) Filed: Mar. 14, 2013

(65) Prior Publication Data

US 2013/0269938 A1 Oct. 17, 2013

Related U.S. Application Data

(60) Continuation of application No. 13/438,644, filed on Apr. 3, 2012, now Pat. No. 8,434,550, which is a division of application No. 13/207,303, filed on Aug. 10, 2011, now Pat. No. 8,418,755, which is a (Continued)

(51) Int. Cl.
*E21B 33/124* (2006.01)
*E21B 33/129* (2006.01)
(Continued)

(52) U.S. Cl.
CPC ..... *E21B 33/1294* (2013.01); *E21B 23/006* (2013.01); *E21B 23/06* (2013.01); *E21B 33/124* (2013.01); *E21B 33/126* (2013.01); *E21B 43/25* (2013.01)

(58) Field of Classification Search
CPC ..... E21B 33/124
USPC ..... 166/119, 133, 141, 142, 188, 305.1, 166/308.1
See application file for complete search history.

(56) References Cited

U.S. PATENT DOCUMENTS 2,606,618 A 8/1952 Page
2,764,244 A 9/1956 Page
(Continued)

FOREIGN PATENT DOCUMENTS

EP 1094195 A 9/2000
EP 1076156 A2 2/2001
(Continued)

OTHER PUBLICATIONS

Notification Concerning Transmittal of International Preliminary Report on Patentability and Written Opinion of the International Searching Authority, Apr. 3, 2008, based on PCT/US2006/036503 filed Sep. 19, 2006, Form PCT/IB/373 and Form PCT/ISA/237, 16 pages.

(Continued)

*Primary Examiner* — Brad Harcourt
(74) *Attorney, Agent, or Firm* — Charles Knobloch; Arnold, Knobloch & Saunders, L.L.P.

(57) ABSTRACT

System, devices, and methods are described relating to the treatment (e.g., perforating, fracturing, foam stimulation, acid treatment, cement treatment, etc.) of well-bores (e.g., cased oil and/or gas wells). In at least one example, a method is provided for treatment of a region in a well, the method comprising: positioning, in a well-bore, a packer above the region of the well-bore, fixing, below the region, an expansion packer, treating the region, the treatment fixing the packer, moving the expansion packer, and moving the packer after the moving of the expansion packer.

17 Claims, 18 Drawing Sheets

Related U.S. Application Data continuation of application No. 12/067,434, filed as application No. PCT/US2006/036503 on Sep. 19, 2006, now Pat. No. 8,016,032, application No. 13/828,768, which is a continuation of application No. 13/207,303, filed on Aug. 10, 2011, now Pat. No. 8,418,755.

(60) Provisional application No. 60/718,481, filed on Sep. 19, 2005, provisional application No. 60/728,182, filed on Oct. 19, 2005.

(51) Int. Cl.

| | |
|---|---|
| ***E21B 23/00*** | (2006.01) |
| ***E21B 23/06*** | (2006.01) |
| ***E21B 33/126*** | (2006.01) |
| ***E21B 43/25*** | (2006.01) |

(56) References Cited

U.S. PATENT DOCUMENTS

| | | | | |
|---|---|---|---|---|
| 2,802,535 | A | 8/1957 | Taylor | |
| 2,828,823 | A | 4/1958 | Mounce | |
| 2,847,073 | A | 8/1958 | Arterbury | |
| 3,169,579 | A | 2/1965 | Haines | |
| 3,554,279 | A | 1/1971 | Meripol et al. | |
| 4,590,995 | A | 5/1986 | Evans | |
| 4,696,344 | A | 9/1987 | Scott et al. | |
| 4,964,460 | A | 10/1990 | Armell et al. | |
| 5,178,219 | A * | 1/1993 | Striech et al. | 166/289 |
| 5,343,956 | A | 9/1994 | Coronado | |
| 5,456,322 | A | 10/1995 | Tucker et al. | |
| 6,131,662 | A * | 10/2000 | Ross | 166/369 |
| 6,131,663 | A | 10/2000 | Henley et al. | |
| 6,325,146 | B1 | 12/2001 | Ringgenberg et al. | |
| 6,328,103 | B1 | 12/2001 | Pahmiyer et al. | |
| 6,394,184 | B2 | 5/2002 | Tolman et al. | |
| 6,446,719 | B2 | 9/2002 | Ringgenberg et al. | |
| 6,446,720 | B1 | 9/2002 | Ringgenberg et al. | |
| 6,474,419 | B2 | 11/2002 | Maier et al. | |
| 6,520,255 | B2 | 2/2003 | Tolman et al. | |
| 6,527,052 | B2 | 3/2003 | Ringgenberg et al. | |
| 6,533,037 | B2 | 3/2003 | Eslinger et al. | |
| 6,543,538 | B2 | 4/2003 | Tolman et al. | |
| 6,575,247 | B2 | 6/2003 | Tolman et al. | |
| 6,655,461 | B2 | 12/2003 | Eslinger et al. | |
| 6,672,405 | B2 | 1/2004 | Tolman et al. | |
| 6,695,057 | B2 | 2/2004 | Ingram et al. | |
| 6,722,437 | B2 | 4/2004 | Vercaemer et al. | |
| 6,729,398 | B2 | 5/2004 | Ringgenberg et al. | |
| 6,776,239 | B2 | 8/2004 | Eslinger et al. | |
| 6,860,326 | B2 | 3/2005 | Kilgore et al. | |
| 6,880,637 | B2 | 4/2005 | Myers, Jr. et al. | |
| 6,926,088 | B2 | 8/2005 | Tinker | |
| 6,957,701 | B2 | 10/2005 | Tolman et al. | |
| 7,059,407 | B2 | 6/2006 | Tolman et al. | |
| 8,434,550 | B2 | 5/2013 | Howard et al. | |
| 2004/0050546 | A1 | 3/2004 | Tinker | |

FOREIGN PATENT DOCUMENTS

| | | | |
|---|---|---|---|
| GB | 2384257 | A | 2/2002 |
| WO | 98/50672 | A1 | 11/1998 |
| WO | 0206629 | A1 | 1/2002 |

OTHER PUBLICATIONS

Notification of Transmittal of the International Search Report and the Written Opinion of the International Searching Authority, or the Declaration, Apr. 3, 2007, based on PCT/US2006/036503 filed Sep. 19, 2006, Form PCT/ISA/210 and Form PCT/ISA/237, 22 pages.

Office Action of mail date Jun. 8, 2012 for co-pending U.S. Appl. No. 13/207,303.

Office action in co-pending Canadian patent application No. 2,623,100 issued Jul. 11, 2013, 2 pages.

Office action mail date Jul. 17, 2012 for related U.S. Appl. No. 13/438,644, patent No. 8,434,550, 10 pages.

* cited by examiner

WELL TREATMENT APPARATUS, SYSTEM, AND METHOD

BACKGROUND

The invention relates to tools and methods of treatment of well-bores that are used, for example, in the exploration and production of oil and gas.

In many of the well-bores (as illustrated, for example, in U.S. Pat. No. 6,474,419, incorporated herein by reference) so-called "packers" are run in on a work string (for example, coiled tubing), to allow for treatment of the well-bore by perforation of casing and/or fracturing operations. The packers become stuck in the well-bore, however, resulting in lost tools and, sometimes, loss of the entire well.

There is a need, therefore, for improved well treatment devices, systems, and methods.

SUMMARY OF THE INVENTION

It is an object of at least some examples of the present invention to provide for well-treatment devices, systems, and methods, that reduce the chance of having a tool stuck in a well and/or for more efficient well-treatment procedures.

In at least one example of the invention, a method is provided for treatment of at least one region in a well, the method comprising:

- positioning, in a well-bore, a first packer above the region of the well-bore,
- fixing, below the region, an expansion packer,
- treating the region,
- moving the expansion packer longitudinally in the well, and
- moving the first packer after the moving of the expansion packer.

In at least one, more specific example, the moving of the expansion packer comprises longitudinally moving a mandrel with respect to the first packer. In a more specific example, the moving of the expansion packer comprises movement of a packer mandrel and a first packer mandrel wherein the first packer mandrel slides within a first packer sleeve. In an even more specific example, the first packer comprises a cup packer; in at least some alternative examples, the first packer comprises an expansion packer (for example, a compressible expansion packer).

In still a more specific example, a further step is provided of opening a valve, thereby communicating the region with the portion of the well-bore below the expansion packer, wherein the opening is caused by movement of the packer mandrel. In at least one such example, the opening a valve occurs below the expansion packer.

In a further example, the step of moving the first packer comprises, first, lowering the first packer below the treated region, and the step of moving the first packer then comprises raising the first packer after the step of lowering the first packer.

According to still another example of the invention, a system is provided for treatment of the region in a well, the system comprising: a first packer, a first packer mandrel disposed radially inward of the first packer, an expansion packer, an expansion packer mandrel disposed radially inward of the expansion packer, means for treating the region, wherein the means for treating the region is disposed between the first packer and the expansion packer, means for moving the expansion packer, and means for moving the first packer after the moving of the expansion packer.

In at least one such system, the means for moving of the expansion packer comprises means for longitudinally moving a mandrel with respect to the first packer. In a further system, the means for moving of the expansion packer comprises a packer mandrel having a substantially rigid connection (either direct or indirect) a first packer mandrel, wherein the first packer mandrel slides within the first packer sleeve. In at least one further example, a means is provided for equalizing pressure above and below the expansion packer before the moving of the first packer. In some such examples, the means for equalizing comprises a valve operated by movement of the packer mandrel and communicating the region with a portion of the well-bore below the expansion packer. At least one acceptable valve comprises an opening below the expansion packer.

In still a further example, the means for treating the region comprises a substantially cylindrical member having slots disposed therein.

In yet other examples, means for moving the expansion packer comprises a shoulder on the mandrel engaging a guide, and the means for moving the first packer after the moving of the expansion packer comprises:

- a first packer sleeve slideably mounted on the first packer mandrel,
- a shoulder on the mandrel, and
- a shoulder on the first packer sleeve disposed to stop longitudinal movement of the shoulder on the mandrel.

According to another example of the invention, a packer system is provided comprising:

- a mandrel,
- a sleeve disposed around the mandrel in a longitudinally sliding relation, and
- a packer element fixed to the sleeve.

In at least one such example, a shoulder resides on the sleeve abutting a shoulder on the packer element; a thimble engages the packer element at a first thimble surface; and a retainer ring is threaded on the sleeve. The retaining ring engages the thimble on a second thimble surface. In still another example, a first wiper ring is attached to a first end of the sleeve, and a second wiper ring is attached to the retainer ring. In at least some such examples, a seal is disposed between the sleeve end of the housing.

In some further examples, the sleeve comprises a packer element carrier section having an outer threaded diameter and a stroke housing, the stroke housing having an inner threaded diameter engaging the outer threaded diameter of the packer element carrier. In even further examples, a wiper is connected to an interior diameter of the stroke housing; a seal is disposed between the stroke housing and the mandrel; and a seal is disposed between the stroke housing and the packer element carrier section. In at least some such examples, the packer element carrier section comprises a shoulder; the packer element is disposed between the shoulder and a retainer; and the retainer is threaded to the packer element carrier. In at least one example, a debris barrier is disposed in an interior surface of the retainer. In some examples, the packer element comprises a cup packer element. In further examples, the packer element comprises an expansion packer (e.g. compressible) element.

According to still a further example of the invention, a method is provided for treating a well, the method comprising:

- positioning a compressible expansion packer in the well-bore, the expansion packer being rigidly-connected to an expansion packer mandrel connect to a work string,
- setting the expansion packer in the well-bore with a longitudinal motion of the work string, treating the well, opening a valve below the expansion packer with a further longitudinal motion of the work string, and raising the packer.

At least one such method further comprises positioning a packer in the well-bore above the expansion packer, rigidly connected to a cup packer sleeve. The cup packer sleeve is slideably connected to a cup packer mandrel, and the cup packer mandrel is connected to the work string and to the packer mandrel (at least indirectly).

In at least a further example of the invention, a system is provided for treating a well-bore on a work string, the system comprising:

an expansion packer mandrel for substantially rigid-connection to the work string, means for setting a compressible expansion packer in a well-bore with a longitudinal motion of the work string, means for treating the well, means, below the expansion packer, for equalizing a pressure differential across the expansion packer, and means for raising the expansion packer.

In at least one such example, the means for setting the compressible expansion packer comprises at least one J-slot on the expansion packer mandrel interacting with at least one J-pin on a slip ring disposed about the expansion packer mandrel.

In at least a further example, the means for treating the well comprises a substantially cylindrical member having slots therein.

In still another non-limiting example, the means for equalizing comprises a valve.

In yet a further example, the means for raising the expansion packer comprises a stop surface (e.g., a shoulder) on the mandrel and a stop surface on the expansion packer, wherein the stop surfaces interact to cause the expansion packer to be raised during vertical motion of the expansion packer mandrel.

In still another example of the invention, a method is provided for treating multiple zones in a cased well-bore, the method comprising:

fixing an expansion packer of a work string below a first zone, perforating the cased well-bore above the expansion packer, applying between the work string and the cased well-bore, a stimulation fluid through the perforated well-bore, equalizing the pressure above and below the expansion packer, fixing the expansion packer at a second zone, the second zone being over the first zone, perforating the cased well-bore above the expansion packer, applying, between the work string and the cased well-bore, a stimulation fluid through the perforated well-bore, equalizing the pressure above and below the expansion packer, and raising the expansion packer.

In at least one such method the equalizing comprises opening a valve below the expansion packer. In a further example, the opening comprises moving a valve port connected to an expansion packer mandrel from contact with a valve seat connected to a drag sleeve.

Still a further example of the invention provides a system for treating multiple zones in a cased well-bore, the system comprising:

means for perforating the cased well-bore above the expansion packer, means for applying, between the work string and the cased well-bore, a stimulation fluid (e.g. fracturing fluid, foam, etc.) through the perforated well-bore, means for equalizing the pressure above and below the expansion packer, and means for raising the expansion packer.

In at least one such system, the means for equalizing comprises a valve below the expansion packer. In a further system, the means for equalizing also comprises a valve port connected (directly or indirectly) to an expansion packer mandrel, the valve port reciprocating from contact with a valve seat connected to a drag sleeve. In still another example, the means for perforating the cased well comprises a jetting tool; while, in yet another example, the means for applying comprises a surface pump connected between the well casing and the work string, and the means for raising the expansion packer comprises a connection between an expansion packer guide and an expansion packer mandrel.

An even further example of the invention provides an expansion packer device comprising:

a mandrel having a substantially cylindrical bore therethrough, a compressible packer element disposed about the mandrel, a set of casing-engaging elements disposed about the mandrel, a set of drag elements disposed about the mandrel, a set of slots in an outer surface of the mandrel, a set of slot-engaging elements engaging the set of slots and disposed about the mandrel, the slot-engaging elements being longitudinally and radially moveable about the mandrel, a valve port located outside the cylindrical bore and below the set of slots, and a valve seat located outside the valve port.

In at least one such expansion packer, the valve port is located below the mandrel. In a further example of the invention, a drag sleeve is provided in a longitudinally-slideable relation to the mandrel, and the drag sleeve comprises the valve seat. In yet a further example, the drag sleeve further comprises openings above the valve seat. In still another example, the valve seat is longitudinally adjustable with respect to the valve port. In an even further example, the valve port is located below the mandrel and is positioned between elastomer, grooved seals that have, for example, a concave surface.

In at least one example, the drag sleeve also comprises: a slide member in longitudinally-slideable engagement with the mandrel and a seat housing, longitudinally and adjustably attached to the slide member. In at least one such example, the seat housing is threaded to the slide member. In a further such example, rotation of the seat housing on threads connecting the seat housing to the slide member adjusts a longitudinal distance the valve ports travel to engage the valve seat.

Still another example of the invention provides a well fracturing tool comprising:

a cylinder having longitudinal slots therein, threads located at a packer-engaging end of the cylinder, wherein a portion of the slots located closest to the packer-engaging end is between about 10" and about 14" from the packer-engaging end.

In at least one such tool, the portion of the slots located closest to the packer-engaging end is about 13" from the packer-engaging end.

The above list of examples is not given by way of limitation. Other examples and substitutes for the listed components of the examples will occur to those of skill in the art.

Further, as used throughout this document the description of relative positions between parts that relate to vertical position are also intended to apply to non-vertical well bores. For example, in a well-bore having a slanted component, or even a horizontal component, a port is "above" or "over" another port if it is closer (along the well-bore) to the surface than the other port. Thus, a cup packer that is in a horizontal well-bore is "above" an expansion packer in the same well-bore if, when the cup packer is removed from the well-bore, it precedes the expansion packer.

DETAILED DESCRIPTION OF THE DRAWINGS

Figure 1:
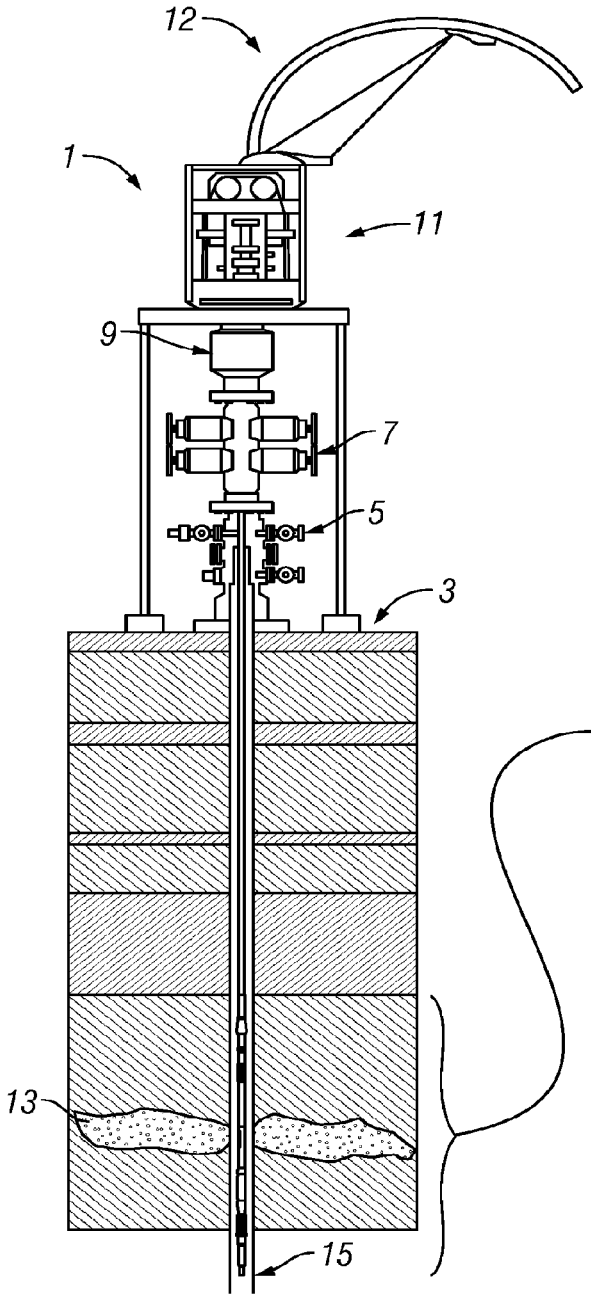
FIG. 1 is a side view of an example embodiment of the invention.
Figure 1A:
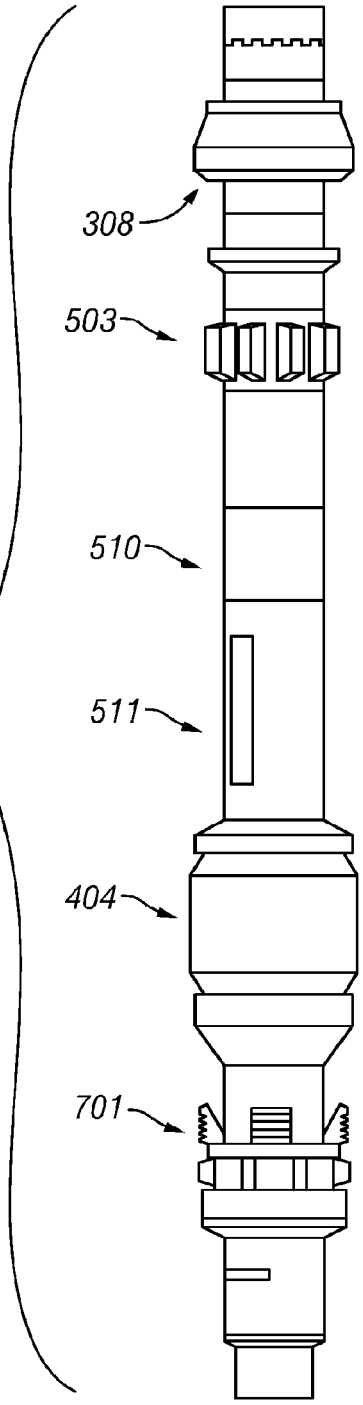
FIG. 1A is a side view of an enlargement of a portion of the example of FIG. 1.
Figure 2B:
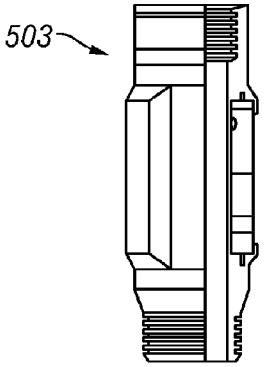
Figure 2A:
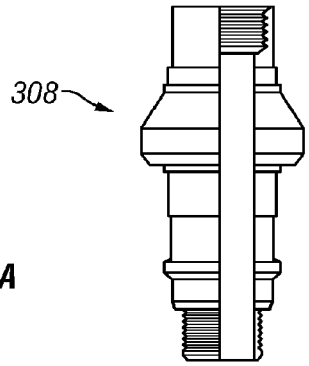
Figure 2:
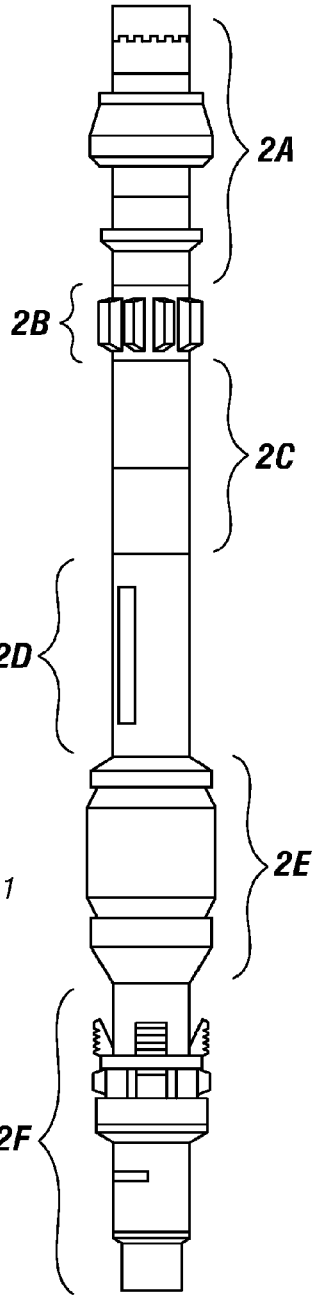
Figure 2D:
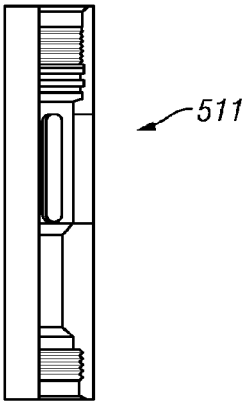
Figure 2C:
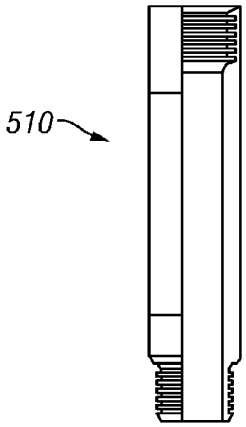
Figure 2F:
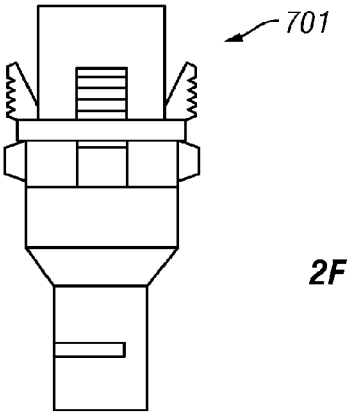
Figure 2E:
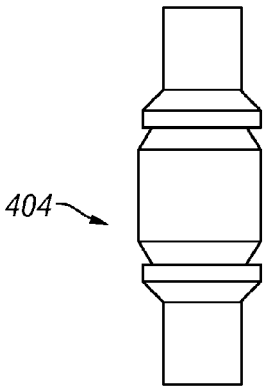

FIG. 2 is a side view of a set of enlargements of a portion of the example of FIGS. 1 and 1A. FIG. 2A is a side view enlargement of a cup packer 308. FIG. 2B is a side view enlargement of a centralizer section 503. FIG. 2C is a side view enlargement of a spacer joint 510. FIG. 2D is a side view enlargement of a ported section 511. FIG. 2E is a side view enlargement of an expansion packer section 404. FIG. 2F is a side view enlargement of a well-bore engagement section 701.

Figure 3:
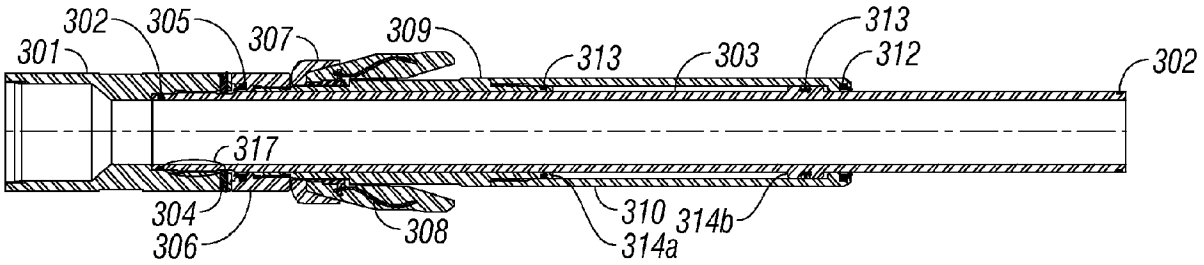

FIG. 3 is a sectional view of a portion of an example of the invention.

FIGS. 3A-3D are sectional views of a portion of an example of the invention.

Figure 4:
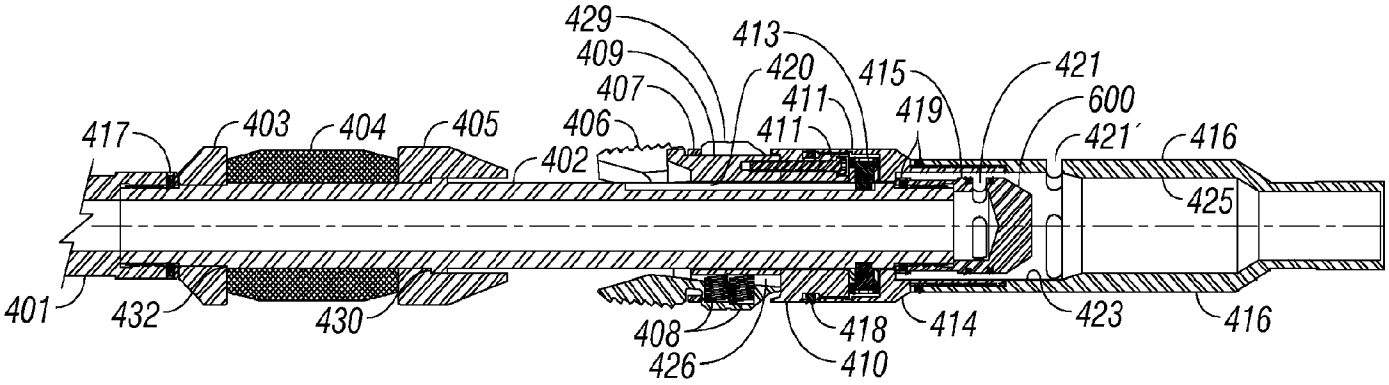

FIG. 4 is a sectional view of a portion of an example of the invention.

Figure 4A:
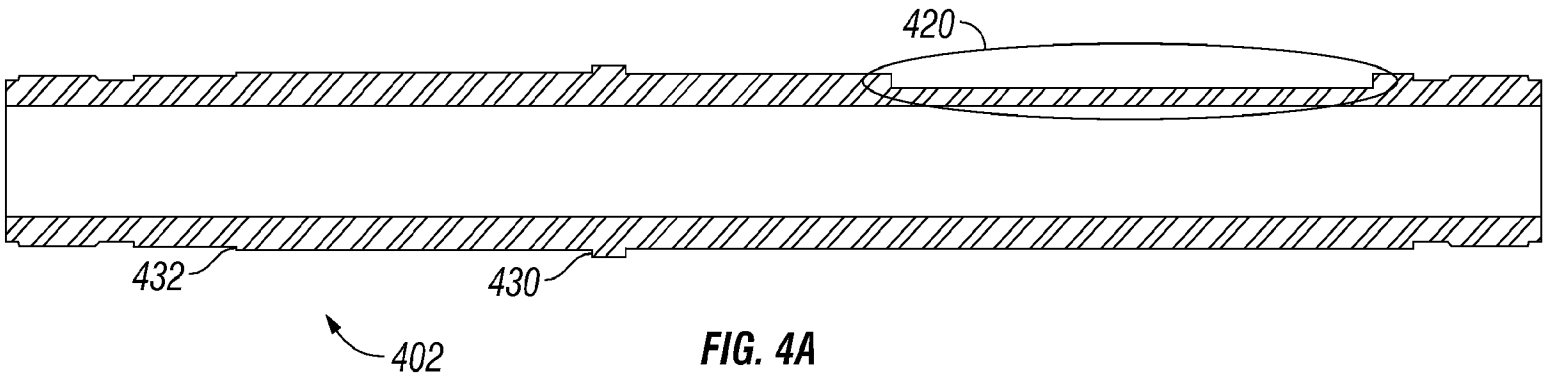
Figure 4B:
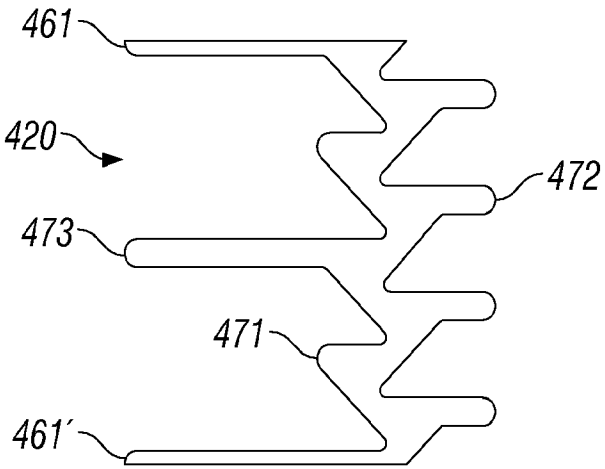

FIGS. 4A-4B are sectional views of a portion of an example of the invention.

Figure 4C:
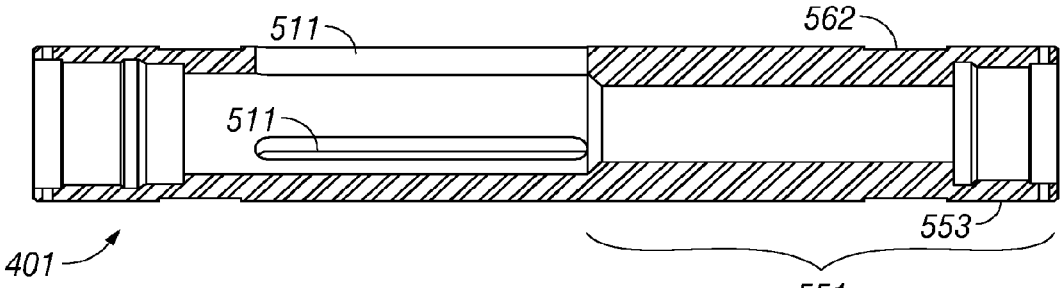

FIG. 4C is a flattened view of a portion of a surface of a cylindrical member example of the invention.

FIGS. 4D-4K are sectional views of a portion of an example of the invention.

FIGS. 5A-5D are sectional views of an example of the invention in a "run-in" state.

FIGS. 6A-6D are sectional views of an example of the invention in a "treat" state.

FIGS. 7A-7D are sectional views of an example of the invention in a "pressure relief" state.

Figure 8A:
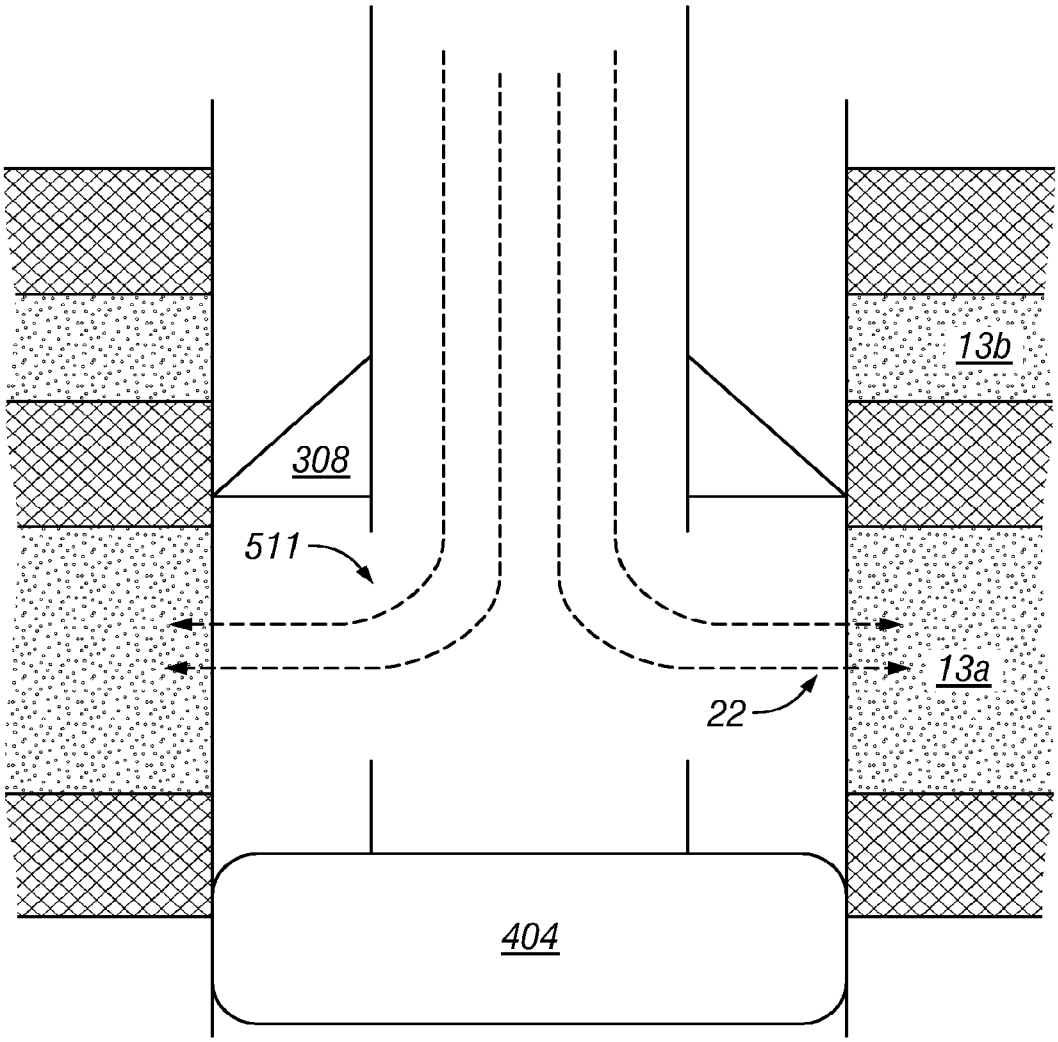
Figure 8B:
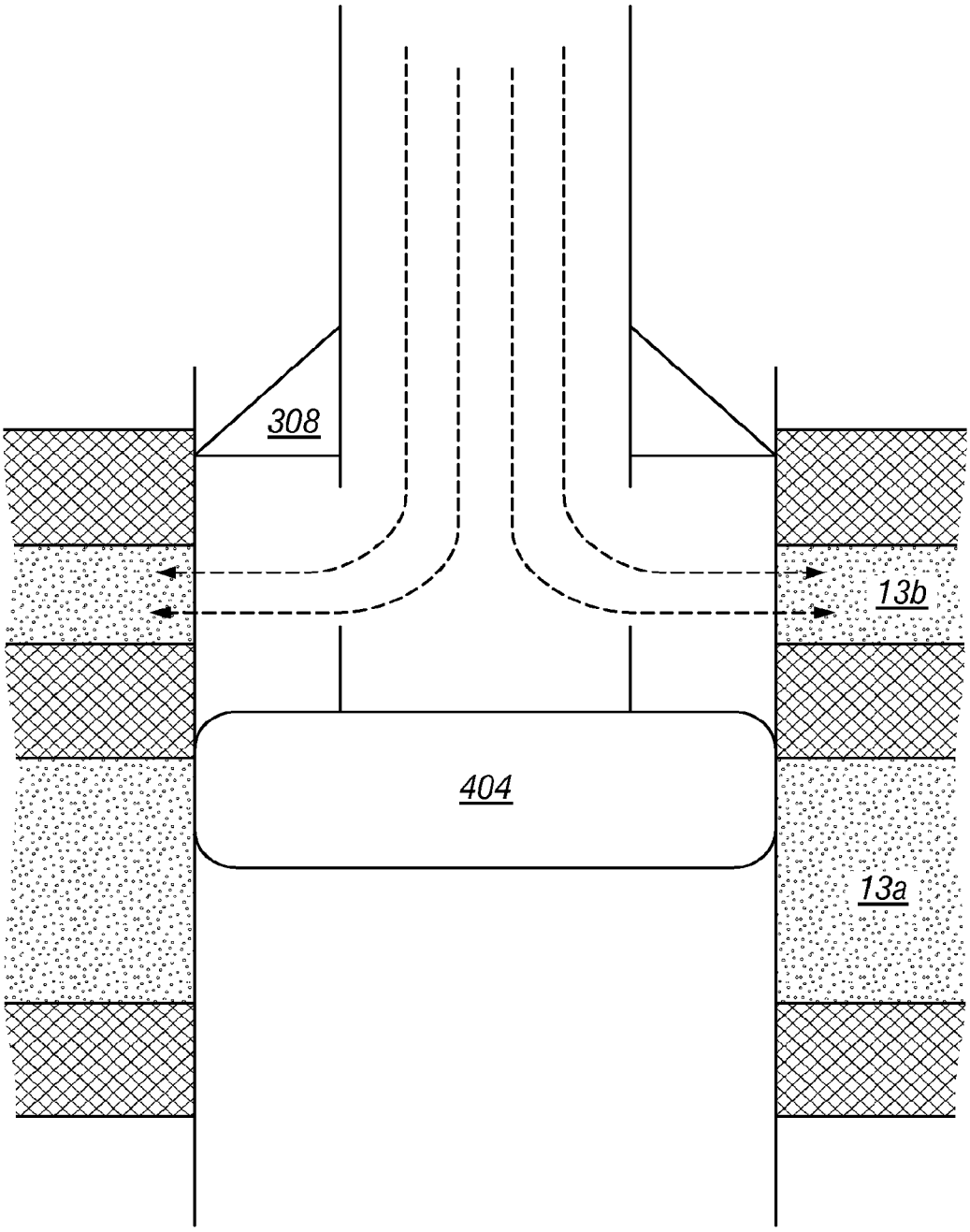

FIGS. 8A-8B are side views of an example of the invention treating multiple strata.

Figure 9:
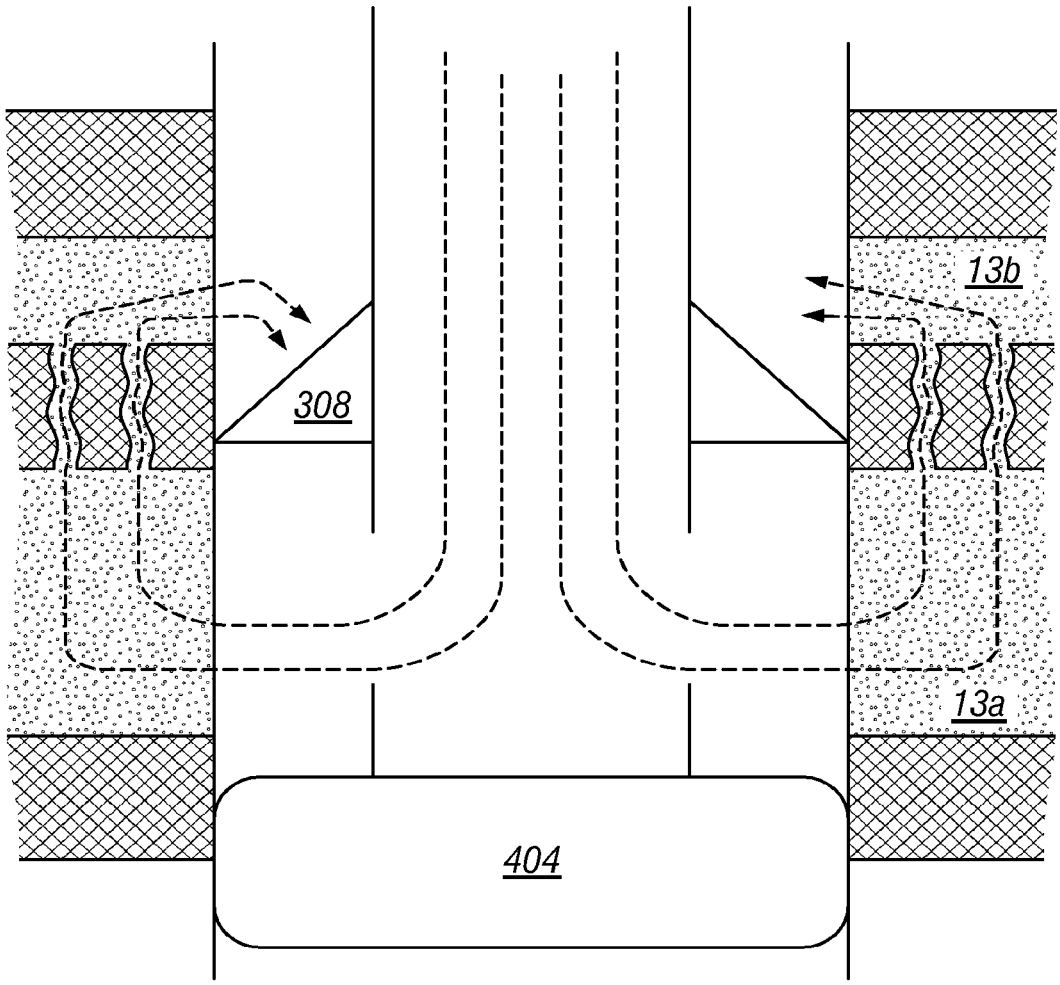
Figure 10:
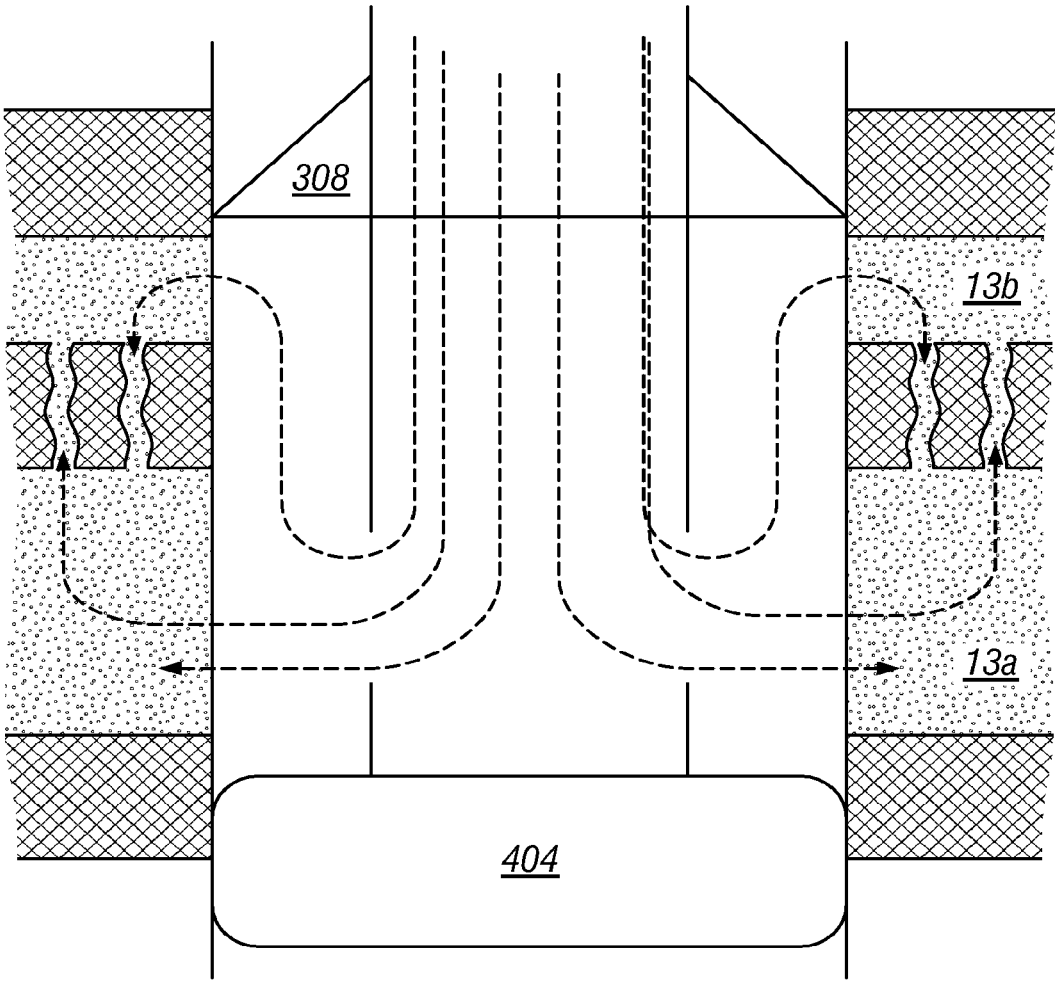

FIGS. 9-10 are side views of an example method of use according to an example of the invention.

Figure 11A:
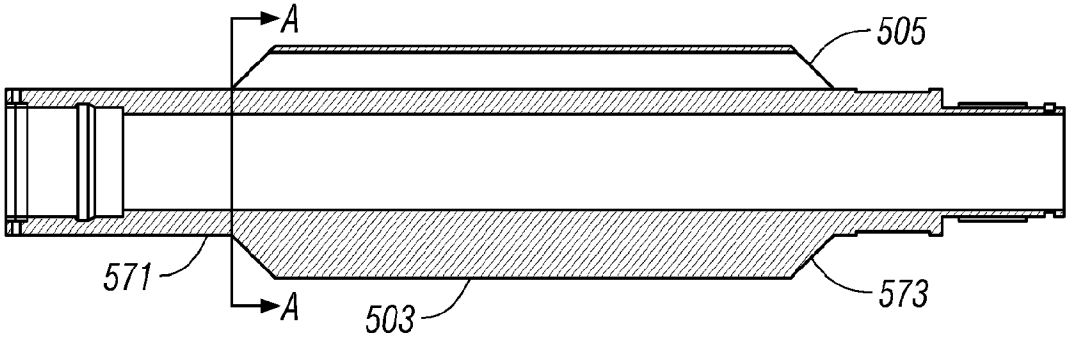
Figure 11C:
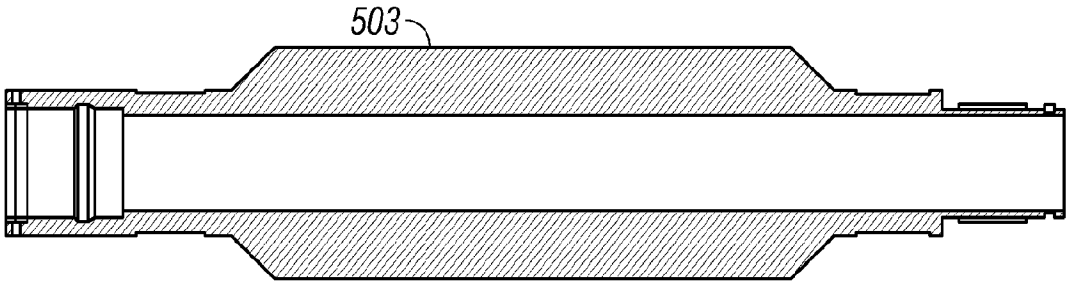
Figure 11B:
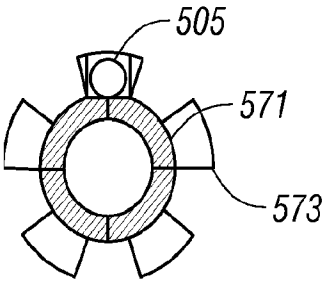

FIGS. 11A-11C are sectional views of an example of the invention.

DETAILED DESCRIPTION OF EXAMPLE EMBODIMENTS

Referring now to FIG. 1, a well-site, generally designated by the numeral 1, is seen. In the figure, a well-head 5 that is attached to the ground 3 has blow-out preventers 7 attached to the well head 5. A lubricator 9 is seen connected under injector 11 that injects coiled tubing 12, through lubricator 9, blow-out preventer 7, well-head 5, and into the well-bore. In many situations, the well-bore is cased with casing 15. Seen in the well-bore at an oil and/or gas, strata 13 is an example of the present invention straddling the oil and/or gas strata 13.

In FIG. 1A, an enlargement of the example from FIG. 1 is seen in which a cup packer 308 is connected through centralizer section 503, spacer joint 510, ported section 511, expansion packer section 404, and well-bore engagement section 701. FIG. 2 and FIGS. 2A-2F show enlargements of each of the sections discussed above.

Referring now to FIG. 3, a cross-section of an example cup-packer assembly is seen comprising a top connector section 301 that is connected by threads to mandrel 303. A socket set screw 304 prevents connector 301 and mandrel 303 from unscrewing. An O-ring seal 302 (for example, an SAE size 68-227, NBR90 Shore A, 225 PSI tensile, 175% elongation, increases the pressure that can be handled by the assembly, allowing a relatively low pressure thread 317 for the connector.) In at least one example, thread 317 comprises *2.500-8 STUD ACME 2G, major diameter 2.500/2.494, pitch diameter 2.450/2.430, minor diameter 2.405/2.385, blunt start thread. As used in this example, many of the dimensions (and even other threads) have been found useful in the design of a 5½" casing tool. Similar dimensions, threaded connections, etc., are used in the examples seen in the figures, which will not be described in detail, that also allow for lower pressure treads with secondary seals to be used. Other dimensions and pressure sealing arrangements will be used in other size tools (for example, 4½" and 7" tools) and other pressure considerations that will occur to those of skill in the art.

Further, connections other than threads, and/or other materials, will be used by those of skill in the art without departing from the invention. In at least one example of the parts seen in the figures, the following rules of thumb are observed (dimensions in inches): (1) machined surfaces .X-.XX 250 RMS, .XXX 125 RMS, (2) inside radii 0.030-0.060; (3) corner breaks 0.015×45°; (4) concentricity between 2 machined surfaces within 0.015 T.I.R.; (5) normality, squareness, parallelism of machined surfaces 0.005 per inch to a max of 0.030 for a single surface; (6) all thread entry & exit angles to be 25°-45° off of thread axis. A thread surface finish of 125 is acceptable. Materials useful in many examples of the invention include: 4140-4145 steel, 110,000 MYS, 30-36c HRc. Other rules of thumb that will be useful in other embodiments will occur to others of skill in the art, again without departing from the invention.

In the example shown, cup retainer 306 holds thimble 307 against cup element 308, which is, itself, held against a shoulder 314*a* of cup carrier sleeve 309. Cup retainer 306 is threaded to cup carrier sleeve 309, causing cup element 308 to be slideably mounted along and around mandrel 303. Being slideable around mandrel 303 allows cup element 308 to spin, allowing it to clear debris more easily than if it were no table to move in that dimension.

Cup carrier sleeve 309 is connected, in the illustrated example, by threads and an O-ring seal 313 to stroke housing 310. A piston-T-seal (for example, a Parker 4115-B001-TP031) prevents flow of fluid and pressure from entering between stroke housing 310 and mandrel 303. By using a low-pressure thread (such as an "SB" thread), a wide torque range is enabled, which allows "make up" of the work string with smaller tools. A wiper ring (for example, Parker SHU-2500) is used at the end of stroke housing 310. Similarly, wiper ring 305 also operates as a debris-barrier.

In operation, which is described more below, cup element 308 slides on cup holder 309 about mandrel 303. Shoulder 314*a* of cup carrier sleeve 309 and shoulder 314*b* of mandrel 303 define the travel distance that the mandrel 303 and cup carrier sleeve 309 are able to slide, longitudinally, with respect to each other. Since connector 301 is fixed longitudinally to mandrel 303, if the coiled tubing (which is attached to connector 301) is pulled from above, mandrel 303 will move upward and slide within cup sleeve carrier 309; therefore, cup element 308 does not have to move in order to move mandrel 303. Therefore, tools (such as expansion-packers) that are below cup element 308 can be manipulated longitudinally without the need to move a cup packer fixed above them.

In at least one example, an expansion packer that is longitudinally operable with J-slots is used, and the travel distance is sufficient to allow a stroke that is larger than the length of the J-slots. It has been found that it is especially useful to allow some distance greater than the J-slots because, when an expansion packer is being positioned and set, drag elements on the packer (e.g., springs, pads, etc.) will slip. For a 5½" tool, for example, about 10" has been found to be sufficient for the travel distance between shoulders 314*a* and 314*b* to allow for a 6" J-slot travel.

Referring now to FIG. 4, an example expansion packer assembly is seen. In the illustrated example, expansion packer mandrel 402 is connected by threads backed by a set screw 417 to an upper element 401 (for example, a slotted "sub" used for applying fracturing fluid in some examples). Therefore, when the work string is lifted from above, expansion packer mandrel 402 is lifted. Expansion packer mandrel 402 includes a shoulder 430 against which setting cone 405 abuts. Expansion packer element 404 is slid up against setting cone 405, and guide ring 403 is slid up against expansion packer element 404. The attachment of upper element 401 against guide 403 holds guide 403 against a shoulder 432 in mandrel 402; and, therefore, when setting cone 405 is pushed toward guide 403, longitudinally, element 404 is compressed and expands radially outward from mandrel 402, due to the rigid connection of guide 403 backed by upper element 401. Likewise, when mandrel 402 is lifted from above, shoulder 432 causes guide 403 to move longitudinally away from setting cone 405, allowing decompression and elongation of packer element 404.

In operation, when a cup packer is set (as seen in FIG. 1) above an oil and/or gas containing strata 13, and an expansion packer is set below an oil and/or gas containing strata 13, well treatment (for example, perforation and/or fracturing operations) occur. After treatment, it is desirable to move the expansion packer and/or the cup packer. However, many times, there is a pressure differential across the expansion packer. To relieve that pressure differential, at least one valve port 421 is provided outside of the mandrel 402.

Figure 4D:
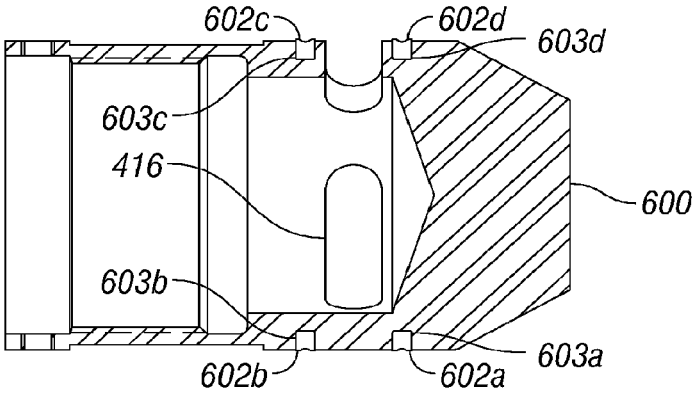
Figure 4E:
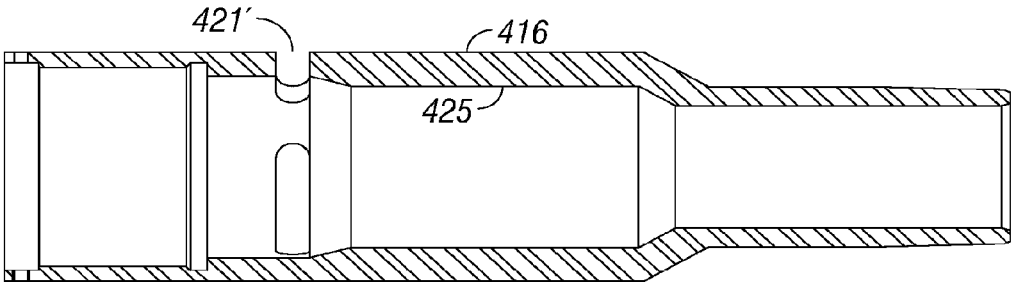

In the illustrated example, port 421 operates with a valve-seat surface 425 (which has a diameter less than the diameter of surface 423 above openings 421'). Openings 421' are located in equalizing sleeve 416. Ports 421 are provided, in the illustrated example, by threading equalizing housing 600 onto mandrel 402; a set screw is again used to prevent the elements from becoming detached. Referring now to FIG. 4D, ports 421 are sealed against surface 425 in equalizing sleeve 416 (FIG. 4E) by seals 602*a*-602*d* (for example, nitrile elastomer between about 70 to 90 shore hardness; in higher temperature viton elastomer). Other elastomers will occur to those of skill in the art. In some examples, the seal material consists essentially of NBR 80 shore A, 2000 PSI Tensile, 300% Elongation. Further, a concave is seen in seals 602*a*-602*d*. Such a concave allows a reduction of force needed to put the seal into the seal bore. The dimensions of the seals 602*a*-602*d* in some examples are substantially the same as if two o-rings were located in housing 600; for example, the concave in seals 602*a*-602*d* is about the same size as the gap that would be formed by two o-rings positioned side-by-side.

Figure 4F:
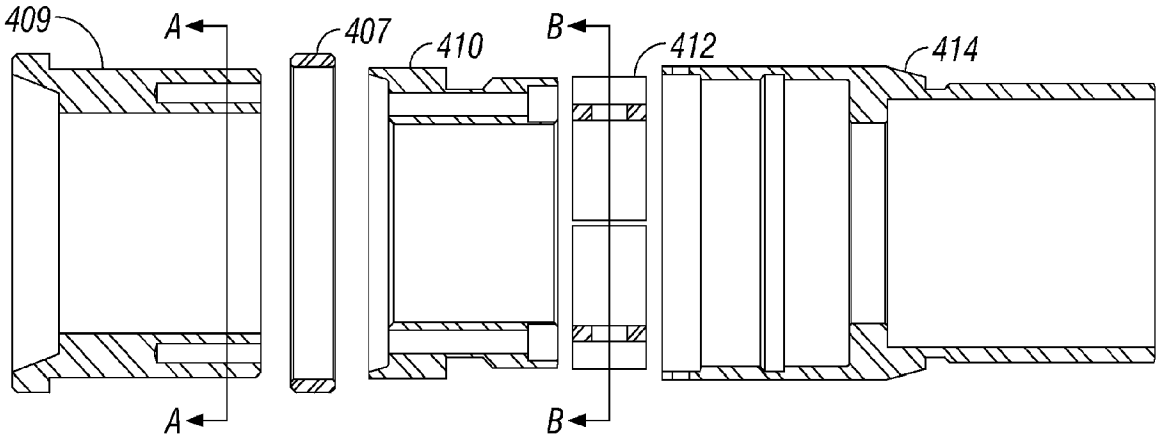
Figure 4K:
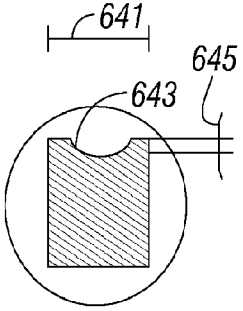

FIG. 4K shows an example of seals 602*a*-602*d*. For an equalizing housing 600 having a diameter between about 2.640 inches to about 2.645 inches (which is particularly useful in a 4½" tool), with a groove width of between about 0.145" and about 0.155", and seals 602*a*-602*d* have a protrusion distance 645 of about 0.020 inches from housing 600, while the radius of curvature of concave surface 643 is about 0.06 inches. In at least one 5½" tool example, grooves 603*a*-603*d* are between about 0.145 inches and about 0.155 inches, and the radius of curvature of groove surface 643 is about 0.06 inches.

It will be noted that there is no requirement for a "longitudinal opening" of the type described in U.S. Pat. No. 6,474,419, nor is there a need for a valve extending up into the packer mandrel. A significant advantage of the example valve ports being, outside the mandrel (and, in at least some cases, below the mandrel) is that a larger flow path is available than with valves located within the mandrel. This allows the tool to be run in the well-bore faster and causes the tool to have less problems with debris.

Referring again to FIGS. 4 and 4F (taken through line "A" of FIG. 4G), 4G, 4H, 4I, and 4J, equalizing sleeve 416 is connected by threads to lower component 414 that is slideably mounted (longitudinally and radially in the example shown) around mandrel 402. Lower component 414 covers J-pins 413 that engage a J-slot 420 that is formed in the surface of mandrel 402. J-pins 413 are held in a slip-ring 412 (described in more detail below) that spins around mandrel 402. Threaded to lower component 414 is a slip-stop-ring 410. Again, a set screw 418 prevents lower component 414 and slip-stop-ring 410 from unscrewing. Slip-stop-ring 410 is seen in the top portion of FIG. 4 connected to slip ring 409 by slip ring screw 411 (for example, ASME B 18.3 hexagon socket-cap head-screw, 5¹⁄₁₆"-18 UNTC×2.750 long, ASTM A574 alloy steel).

On the bottom of FIG. 4, 180° from slip ring screw 411, slip springs 408 are seen. Springs 408 reside in channel 426 and bias rocker slip 406 against rocker slip retaining ring 407; the biasing action of springs 408 operates against retaining ring 407, causing rocker slip 406 to be biased toward mandrel 402. Therefore, when the packer assembly is being run into the well-bore, the teeth on rocker slip 406 are not engaged with the well-bore.

Referring now to FIG. 4A, mandrel 402 is seen alone, where shoulder 430 and shoulder 401 are more easily seen. Further, J-slot 420 is seen machined into the surface of mandrel 402, in the illustrated example.

FIG. 4B shows the actual shape of J-slot 402, which is formed (e.g., machined) circumferentially around mandrel 402. The top line 461 and bottom line 461' actually do not exist. Those are the lines on which the J-slot 420 joins on the outside of mandrel 402.

Figure 4J:
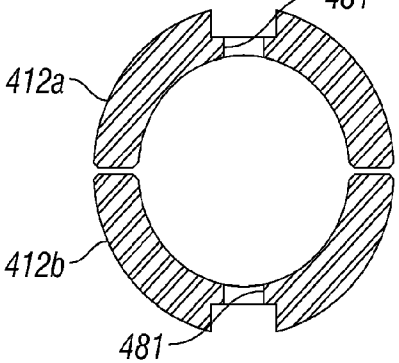
Figure 4H:
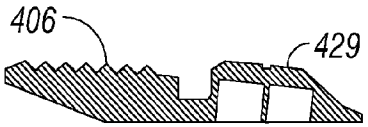
Figure 4I:
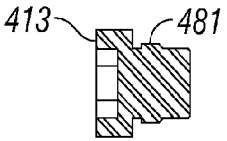
Figure 4G:
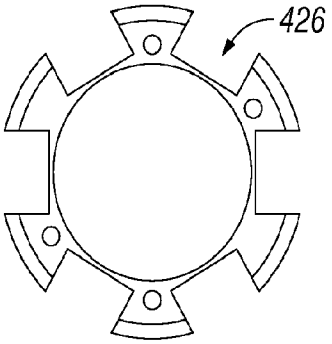

FIG. 4F shows slip ring 412, which, in the example embodiment of FIG. 4J (taken along line B of FIG. 4F) comprises two halves, 412*a* and 412*b*, each of which includes a threaded receptacle 481 that mates with threads 483 of J-pin 413 (FIG. 4I). Fixing J-pins to slip ring 412, rather than floating them without a substantially fixed, radial connection, reduces wear and other problems caused by debris interfering between J-pins 413 and slip ring 412.

With the two J-pins 413 (FIG. 4), each set 180° apart, there are three states for the expansion packer assembly, depending on where the J-pins are located. During the process in which the expansion packer is being run into the well-bore, the J-pins reside in slot 471. Once the expansion packer is in place, an operator lifts the work string (e.g. coiled tubing) from the surface, which lifts mandrel 402. J-pin 413 then shifts from position 471 (FIG. 4B) to position 472. During that shifting, the drag pads 429 (FIG. 4) of rocker slip 406 cause friction between the rocker slip 406 and the well-bore. This allows the mandrel 402 to move upward and the J-pin to change positions. Mandrel 402 is then pushed down from above, causing J-pin 413 to again shift from position 472 to position 473 (FIG. 4B). This shift causes setting cone 405 (FIG. 4) to engage rocker slips 406, causing them to move outward and engage the well-bore. Further movement downward of mandrel 402 causes mandrel shoulder 430 (FIG. 4) to move away from setting cone 405, and expansion packer element 404 expands against the well-bore, sealing the lower portion of the well-bore from the portion of the well-bore above element 404. In this position, ports 421 have moved past opening 421' and are sealed against surface 425.

When mandrel 402 is again lifted (after treatment operations), J-pin 413 again shifts into position 472 (FIG. 4B), causing ports 421 (FIG. 4) to again be in fluid communication with opening 421', and pressure is equalized above and below packer element 404. As will be seen in more detail below, the alignments of ports 421 with opening 421' occurs while packer element 404 may still be substantially engaged with the well-bore.

Also, during treatment operations (such as well fracturing, when fluids containing sand may be used), it has been found that the upper cup packer 308 (FIG. 3) can become stuck. However, the cup packer element 308 is mounted on cup carrier sleeve 309, so that cup mandrel 303 (and, therefore, expansion packer mandrel 402) can slide without the need to move cup element 308. This allows the setting and the operation of pressure release below a fixed cup element.

Figure 3A:
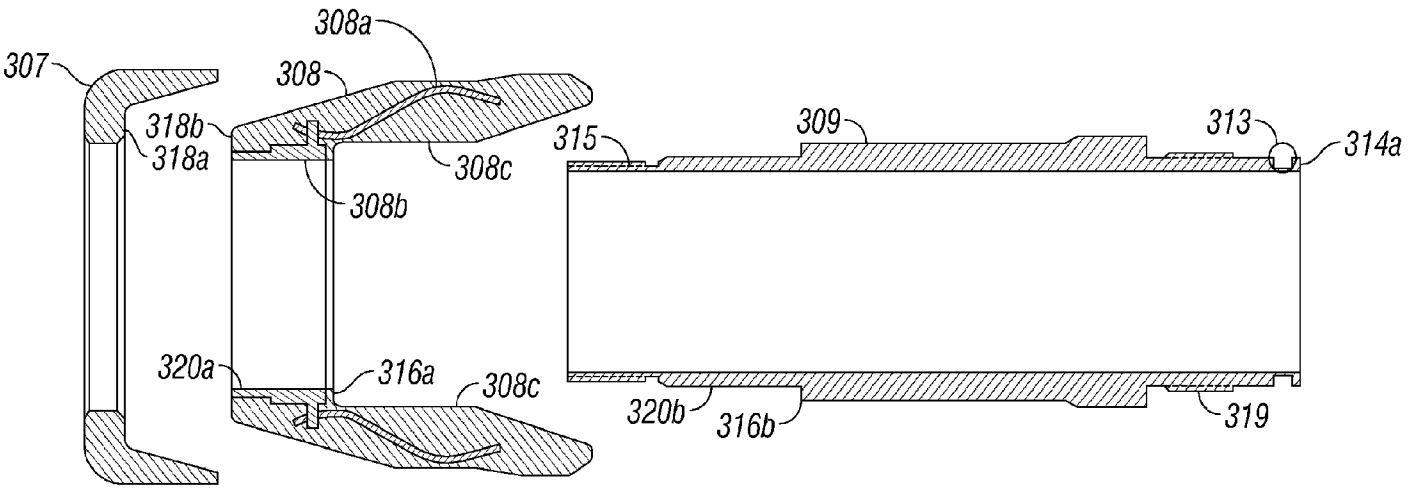

Referring now to FIG. 3A, an assembly view of the cup element assembly is seen. Cup carrier sleeve 309 is positioned to be slid into the cup element assembly such that surface 320*a* of the cup element 308 engages surface 320*b* of cup carrier sleeve 309. In various embodiments, cup element 308 comprises and elastomer (for example, an elastomer seal—for example NBR 80 Shore A), and a spring 308*a* is imbedded in the elastomer material, mounted to cup element ring 308*b*, as shown. In many examples, there is a slight outward taper of the inner surface 308*c* of cup element 308. Thimble 307 holds cup element 308 against cup carrier sleeve 309 by pressing cup surface 316*a* against cup carrier sleeve shoulder 316*b* by engaging thimble surface 318*a* with cup surface 318*b*. As mentioned with reference to FIG. 3, the threading of a cup retainer ring 306 onto sleeve 309 at threads 315 holds the thimble 307, cup element 308 and cup carrier sleeve 309 together.

Figure 3B:
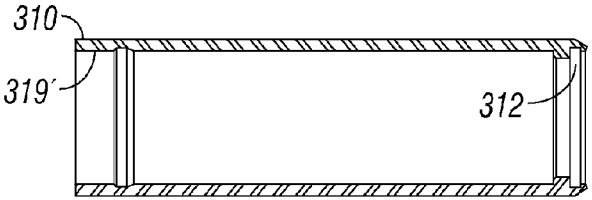
Figure 3C:
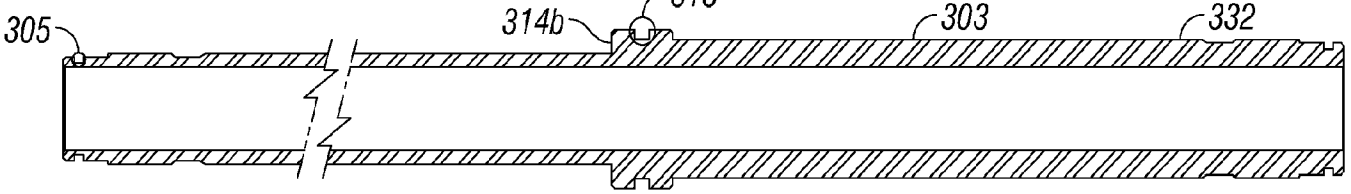
Figure 3D:
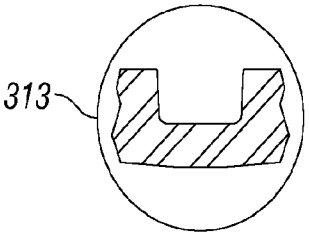

Referring now to FIG. 3C, the cup carrier sleeve is positioned to be slid over cup mandrel 303 (left to right in the Figure) such that surface 314*a* of cup carrier sleeve 309 is stopped by shoulder 314*a* of mandrel 303. A seal 313 is applied around mandrel 303, as shown. Referring now to FIG. 3B, stroke housing 310 is slid over mandrel 303 (from the right as in the Figure); then, pin threads 319 on cup carrier sleeve 309 mate with box threads 319' on stoke housing 310. The connection between cup carrier sleeve 309 and stroke housing 310 is sealed with another seal 313. At the end of stroke housing 310 a wiper ring (not shown) is mounted in wiper ring receptacle 312 (FIG. 3B). FIG. 3D shows a common seal 313 used in connection with stroke housing 310 and cup carrier sleeve 309.

Figure 5A:
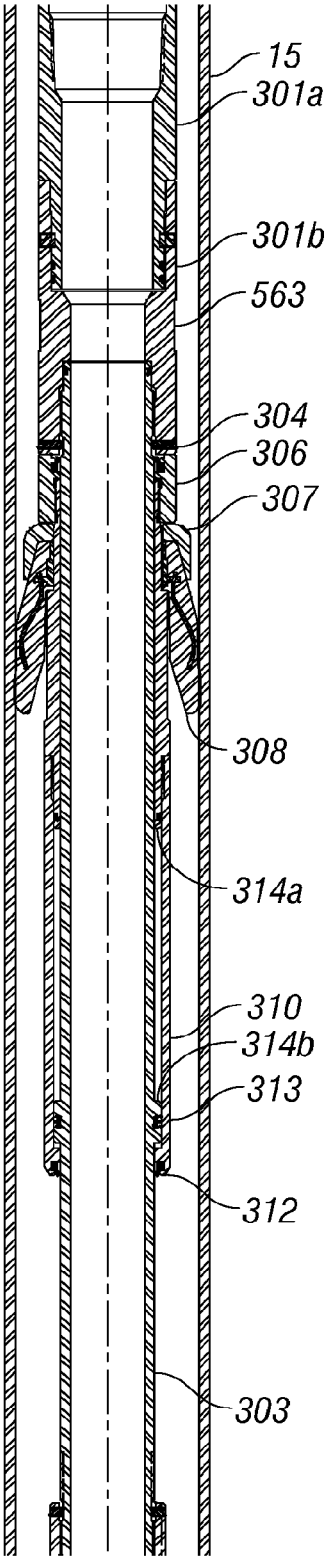

Referring to FIGS. 5A-5D, an example of a system is seen in the "run-in" position (that is, the "state" or positions of the components when seen run into a well-bore). In FIG. 5A, connector 301 comprises two components 301*a* and 301*b*. The form of connector 301 varies depending on a variety of considerations including size, type of work string, treatment method, and other considerations that will occur to those with skill in the art. Cup retainer 306 is run up against connector 301*a*, and the cup sleeve carrier and stroke housing are in a compressed position with respect to cup mandrel 303.

Figure 5B:
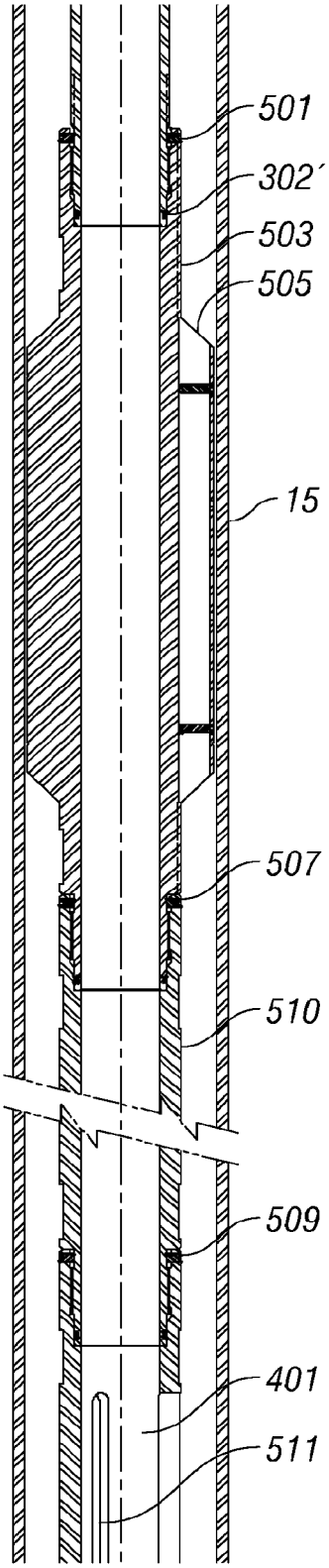

In FIG. 5B, cup mandrel 303 is seen connected to a centralizer 503 that includes a gauge receptacle 505. In some example embodiments, centralizer 503 does not include a gauge receptacle; however, in the illustrated example, gauge receptacle 505 is provided so that an instrument (for example, a pressure gauge) may be positioned in the well during treatment operations. Having pressure measurements from an area close to the location of treatment helps interpretations of the quality of the treatment compared with pressure readings taken at the surface.

FIG. 11A shows an example centralizer 503 with gauge receptacle 505 drilled through, as more fully illustrated in FIG. 11B, taken through line "A" of FIG. 11A. There, barrel 571 of centralizer 503 is surrounded by extensions 573, at least one of which has been drilled through to accept a gauge in receptacle 505. The gauge is mounted, in various embodiments, in many ways that will occur to those of skill in the art; there is no particularly best way to mount such a gauge in receptacle 505.

Centralizer 503 is seen in FIG. 5B connected to space cylinder 510, which is, in turn, connected to ported member 401, which includes port 511. For simplicity, not all of ported member 401 is seen in FIG. 5B.

A more complete view of ported member 401 is seen in FIG. 4C, where slots 511 are formed in a generally cylindrical member 401 that includes an erosion zone 551 between slots 511 and also includes a box thread connector end 553 for connection to an expansion packer assembly. The erosion zone 551 allows erosion of the ported member 401 to occur during treatment—rather than having erosion occur to the expansion packer assembly. In a 5½" tool, for example, erosion zone 551 is between about 12 inches and about 15 inches long. An optimal length for erosion zone 551 has been found to be about 13 inches. Also seen in erosion zone 551 are flats 562 machined into member 401 to allow for a tool to engage member 401 in order to thread member 401 to, for example, spacer 510 and connector 301. Such flats are also provided on other elements (e.g., flats 563 of connector 301B of FIG. 5A, flats 564 of centralizer 503 of FIG. 6B, flats 565 of spacer 510 of FIG. 7A, and flats 567 of equalizing sleeve 416 of FIG. 5C). Such flats may be provided on other components used in and/or with the present invention.

Figure 5C:
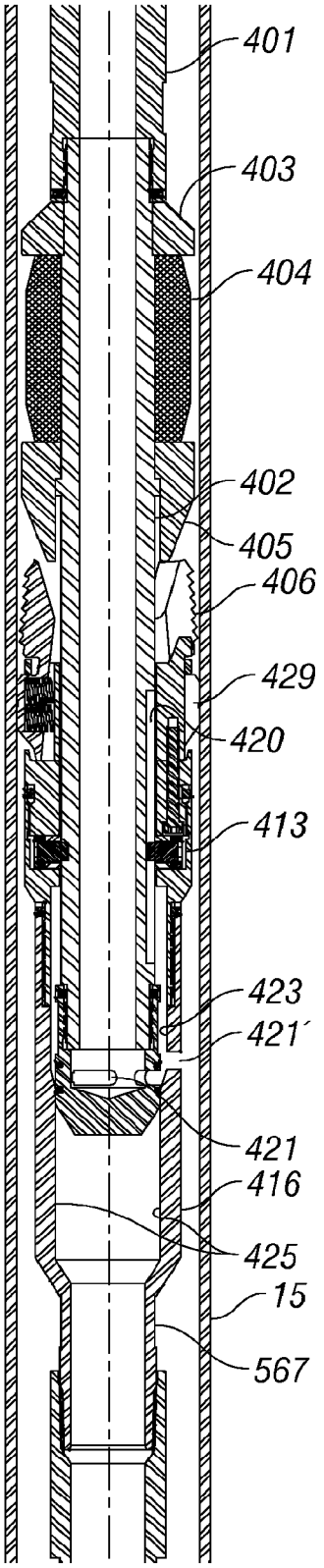
Figure 5D:
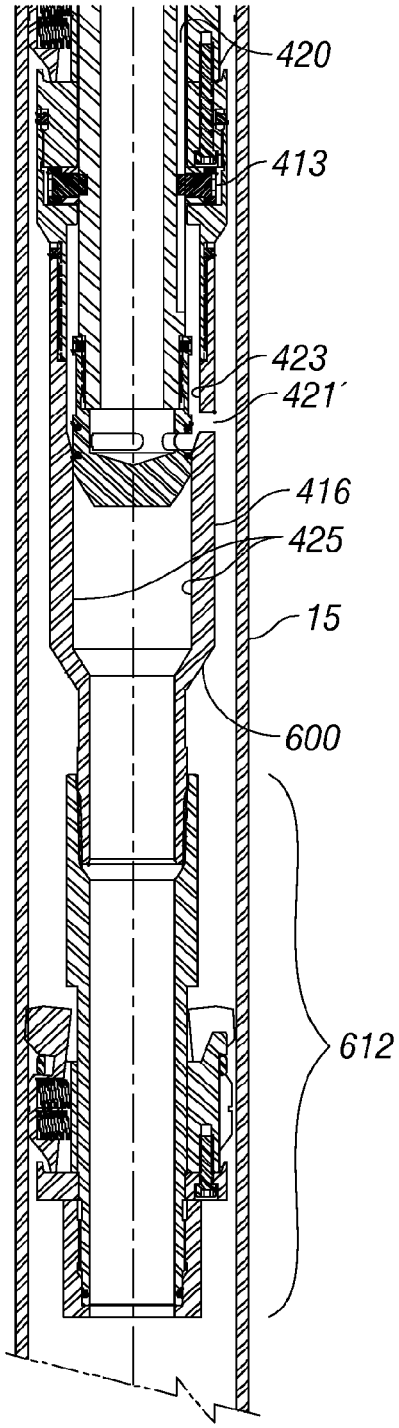

Referring now to FIG. 5C, a lower portion of ported member 401 is seen connected to expansion packer mandrel 402. Because J-pin 413 is in position 471 (FIG. 4B) of J-slot 420, the expansion packer assembly is said to be in a "run-in" position, wherein communication between valve port 421 and opening 421' allows fluid communication between the inner bores of mandrel 402, slotted member 401, spacer cylinder 510, centralizer 503, cup packer mandrel 303, and connector 301 (which is attached, in some examples, to a coiled tubing work string.)

Referring now to FIG. 6A-6D, the system is seen in the treatment position wherein J-pin 413 has been shifted from position 471 to position 472 of FIG. 4B and then to position 473 by, first, lifting on the coiled tubing, which causes the interconnected mandrels to lift with respect to drag pads 429 that drag against well casing 15. Because of the drag of drag pads 429 mandrel 402 rises, and communication is maintained through ports 421 out of opening 421'. The raising of mandrel 402 causes J-slot 413 and slip ring 412 rotate so that J-pin 413 will engage position 472 (FIG. 4B). From position 472, the coiled tubing is lowered, causing mandrel 402 to be lowered with respect to J-pin 413. Such movement causes J-pin 413 to be directed toward position 473 of J-slot 420 (FIG. 4B), allowing further lowering of mandrel 402.

Figure 6A:
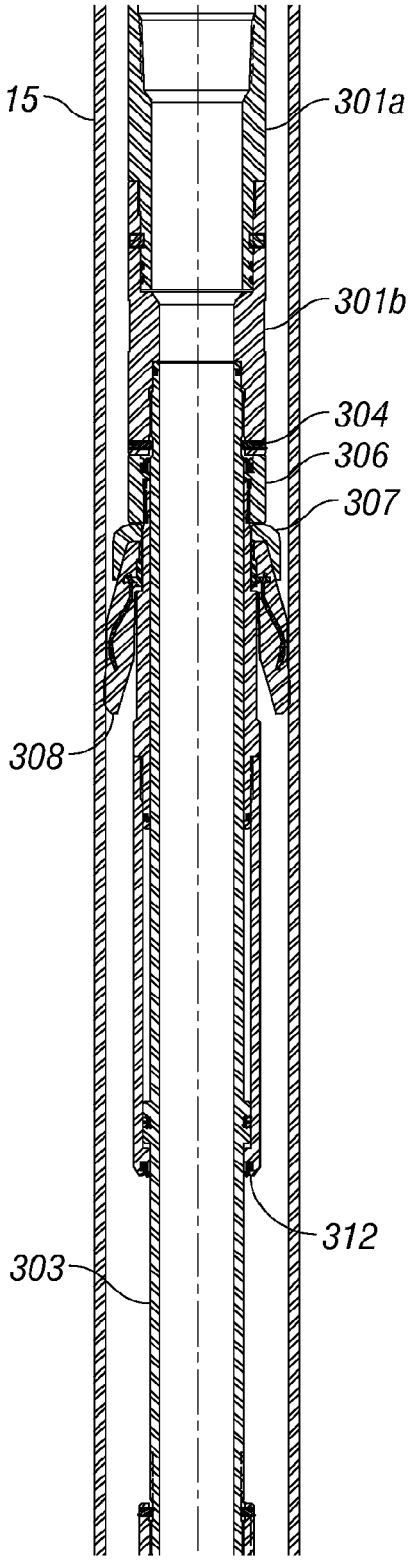
Figure 6B:
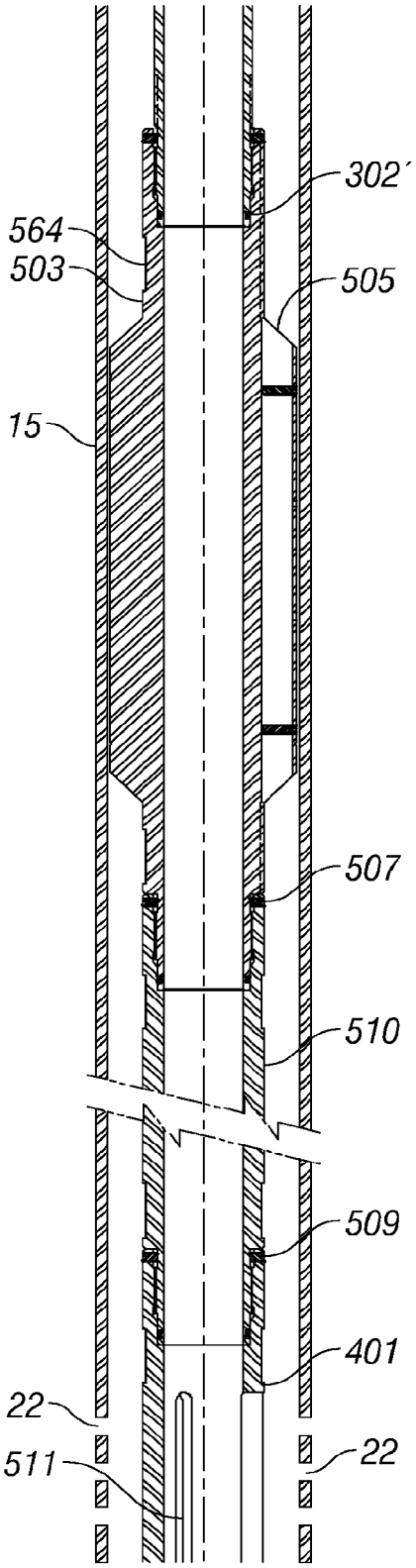
Figure 6C:
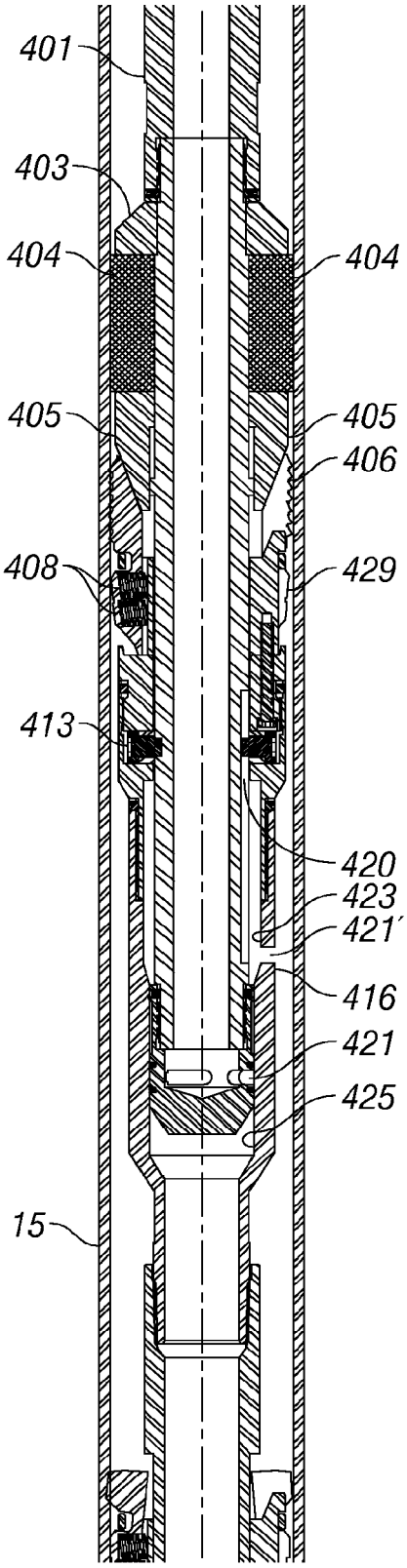
Figure 6D:
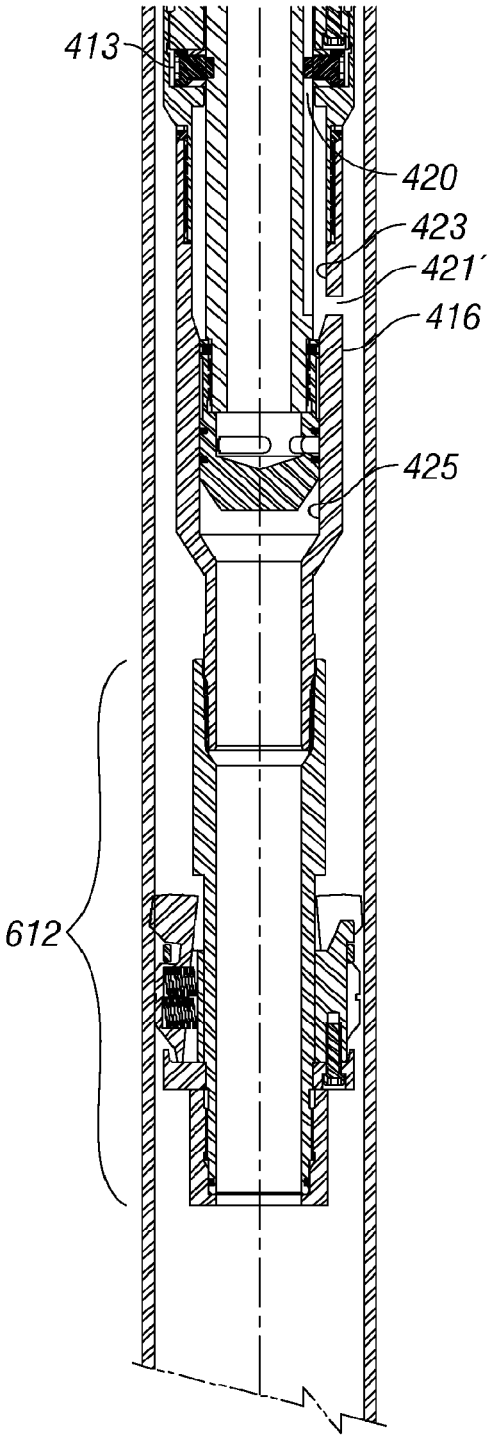

The further lowering, best seen in FIG. 6C causes valve ports 421 to be closed against surface 425 and causes setting cone 405 to engage rocker slips 406. Rocker cone 405 forces rocker slips 406 outward to engage casing 15, halting the downward motion of setting cone 405. Further downward motion of mandrel 402 causes guide 403 to compress expansion packer element 404, which then engages and seals against well casing 15. In such a position, fluid (for example, well fracturing fluid) passes through the bore of connector 301, mandrel 303, centralizer 503 and connector member 510, enters into ported member 401 (FIG. 6B), and passes out of port 511.

The casing at this location has (in some examples) been perforated, causing perforations 22 to communicate the interior of the well casing with oil and/or gas strata 13 (FIG. 1). Due to the nature of fracturing fluid, which usually contains solids (for example, sand), and pressure in the bore of slotted member 401, the fracturing fluid passes through perforations 22 (FIG. 6B) fracturing zone 13 (FIG. 1) and increasing the ability of oil and/or gas to flow from zone 13 into well casing 15.

Referring again to FIGS. 6A-6D, fracturing fluid substantially fills the annulus between member 401 and casing 15 (FIG. 6B); it then passes above and below slotted member 401. The fluid is stopped by packer element 404 (FIG. 6C) and cup packer element 308 (FIG. 6A) which is expanded to due the increase in pressure in the annulus between mandrel 303 and casing 15.

Figure 7A:
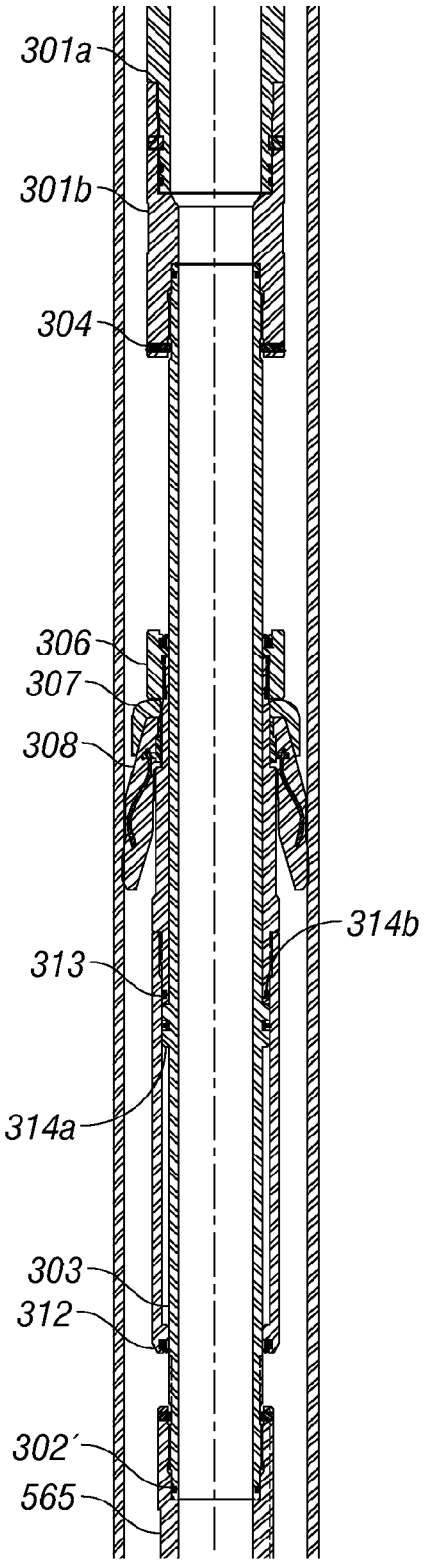
Figure 7B:
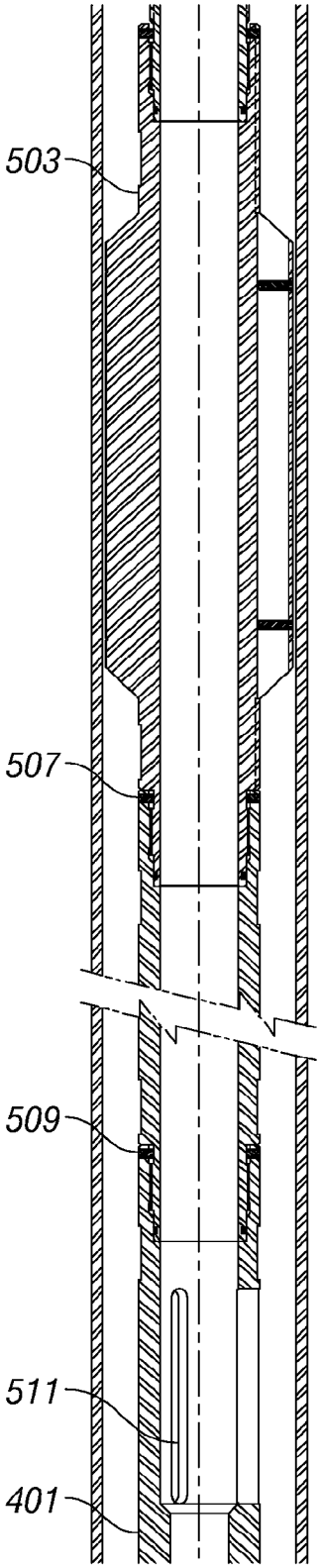
Figure 7C:
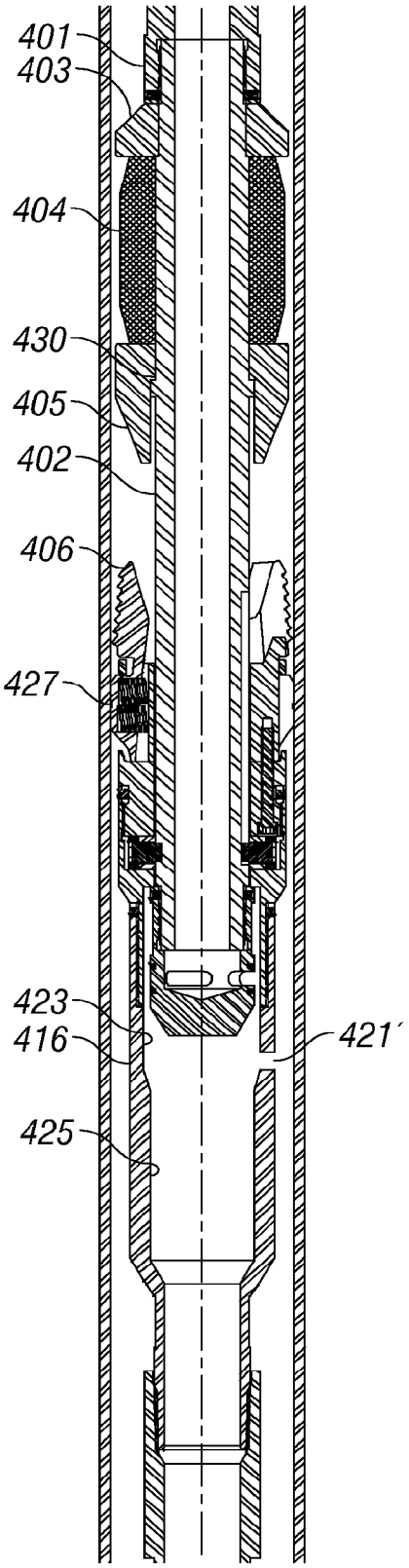
Figure 7D:
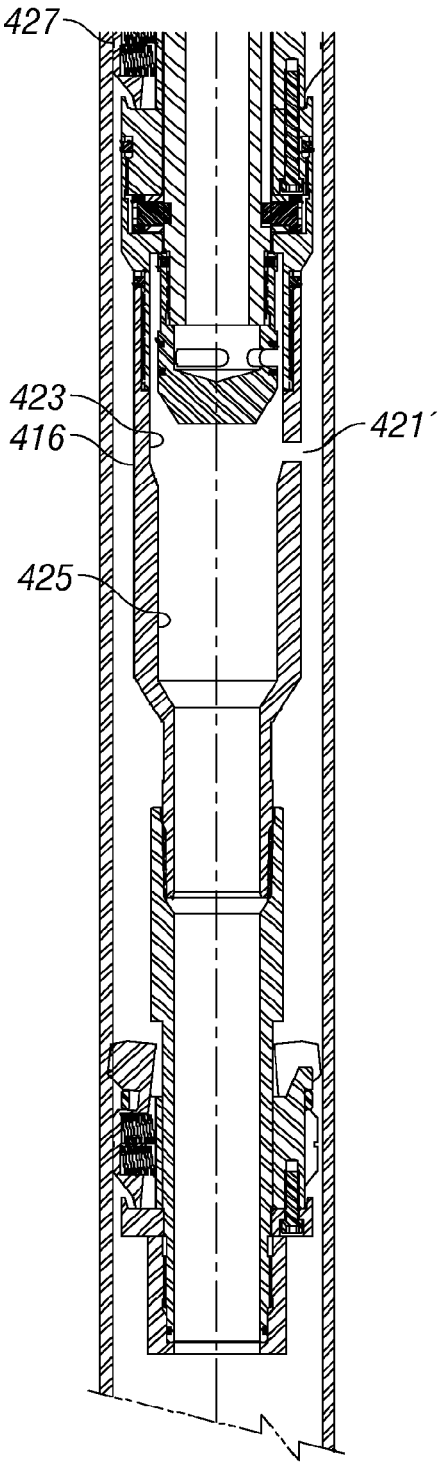

Upon completion of the well treatment, it is desirable to disengage expansion packer 404 and cup packer 308 from well casing 15. However, there is, in many instances, a pressure differential across expansion packer 404 (high pressure above expansion packer 404 and lower pressure below.) Pulling up on expansion packer 404 is difficult due to this pressure, creating a need to relieve the pressure differential. Pulling on cup packer element 308 is, in many instances, not possible; debris during the treatment operation collects above thimble 307. Therefore, the ability of the cup assembly to allow mandrel 303 to slide within cup sleeve carrier 309 without moving cup packer element 308 allows valve ports 421 to become unsealed and communicate with opening 421' with a very small movement of expansion packer guide 403 in a longitudinally vertical direction. During such motion, J-pin 13 (FIG. 4B) slides from position 473 again toward position 472, and port 421 and opening 421' are brought into communication (FIG. 7C). Pressure is therefore relieved above and below expansion packer element 404 and further vertical movement of mandrel 402 is therefore facilitated. As mandrel 402 continues to rise, guide 403 continues to decompress element 404 to a point where fluid flows between packer element 404 and well casing 15. Shoulder 430 of packer mandrel 402 engages cone 405 to lift cone 405.

At this point, J-pin 413 may be brought in alignment with position 471 (FIG. 4B) so that a downward motion can be applied to mandrel 303 (FIG. 7A and FIG. 3) in order to bring connector 301 in contact with cup retainer 306, thimble 307, and cup packer 308. Upon contact, cup packer 308 is forced downward in well casing 15, breaking up and loosening the debris that has been preventing vertical motion of cup packer element 308.

In some examples, an increase in pressure is applied to the region above cup packer 308 by pumping fluid from above and the annulus between mandrel 303 and well casing 15. In some instances, such an increase facilitates compression of cup packer element 308 from above to disengage cup packer 308 from well casing 15 and allow debris to flow past cup packer 308 into lower portions of well casing 15. In other examples, pumping is not conducted, and the solids and debris suspend slightly in well casing 15; such suspension then allows a vertical motion of mandrel 303 to cause cup packer element 308 to move up well casing 15. In further examples, cup packer 308 is lowered past perforations 22 where it is believed that the debris flows out of perforations 22 into the formation—facilitating a clearer casing 15—thus allowing for vertical motion of cup packer 308.

Referring again to FIGS. 5D, 6D, and 7D, attached to equalizing sleeve 416 is locator assembly 612, which is used to give an indication to the operator of when the locator passes a joint or collar in the casing; such locators and other means of locating position in casings are well known to those of skill in the art.

Referring now to FIG. 8A, expansion packer 404 is seen sealing casing 15 below an oil an/or gas containing strata 13*a*; cup packer element 308 seals casing 15 above an oil an/or gas containing strata 13*a*, which is in communication with the interior of casing 15 through perforations 22. Dashed arrows show the flow of well fracturing fluid through slot 511 and into strata 13*a*. After treatment of strata 13*a*, the packers are disengaged; and, as seen in FIG. 8B, they are repositioned to seal above and below an oil an/or gas containing strata 13*b*, which is then treated. In many well-bores, there are many different, vertically-spaced strata to be treated. Therefore, in many such situations, it is desired to treat the lowest most portion 13*a*, disengage packers 404 and 308, raise the assembly to straddle strata 13*b*, and then treat strata 13*b*. This process is continued from a lower portion of the well-bore to an upper region for as many oil and/or gas bearing strata as exist in the well-bore.

However, in some examples (see FIG. 9) there is communication between the first oil and/or gas bearing strata 13*a* and the second oil and/or gas bearing strata 13*b*; the fact or extent of the communication may or may not be known when treatment is conducted. In such circumstances, fluid (seen as dashed lines in FIG. 9) passes through slot 511, into strata 13*a*, up into strata 13*b*, and out of perforations 22 in strata 13*b*. This causes additional debris to be deposited over cup 308. If cup 308 cannot be disengaged, it is then difficult if not impossible to actually treat strata 13*a* without loss of the packer tool.

The sliding nature of cup packer element 308 allows recovery of the packer tool in many cases, and it also allows treatment of multiple strata 13 that are in communication with each other. In such a treatment, the straddle distance (between packers 308 and 404) is increased, as seen in FIG. 10. Use of a sliding cup carrier sleeve such as seen in FIG. 3 or any other longitudinally slideable cup 308 allows the straddle distance to be increased so that multiple zones can be treated in one treatment step. Spacer elements between the cup packer elements (which comprise, in many instances simple cylinders with bores) are used in some examples to.

In some treatment situations, a cup packer is unneeded. For example, after a well-bore has been formed and casing has been set, the casing needs to be perforated; and, in many cases, the strata 13 needs to be fractured. In many well-bores, there are multiple strata to be perforated and fractured, spaced along the well and separated by non oil and/or gas bearing strata. During treatment, it is desirable to isolate a previously-treated strata from the strata being treated, and so treatment is carried out from the lower-most strata to be treated first. An expansion packer is set below the strata being treated, thus isolating the lower portion of the well from the strata being treated. If the casing above the zone being treated has not been perforated, then there is no communication between the well and the strata above the strata being treated. Treatment of multiple strata are then accomplished, in at least one example, by a method comprising the steps of: fixing an expansion packer of a work string below a first strata; perforating the casing above the expansion packer; applying, between the work string and the cased well-bore, a stimulation fluid (e.g., fracturing fluid) through the perforations, equalizing the pressure above and below the expansion packer; fixing the expansion packer up at a second zone, the second zone being over the first zone; perforating the casing above the expansion packer; applying, between the work string and the cased well-bore, a stimulation fluid through the perforations; equalizing the pressure above and below the expansion packer; and again raising the expansion packer. The application of the treatment fluid between the work string and the cased well-bore allows pressure measurements at the surface to more accurately represent the pressure at the perforations without having to account for the friction of fluid passing through the work string bore and through slots (e.g., 511) that would be used if the treatment fluid were passed through the work string.

In at least one example when a treatment process of perforation and treatment between the work string and the well casing is used, no cup packer is positioned in the well-bore, in order to allow the treatment fluid to flow between the work string and the casing. However, again in some examples, in place of the slotted member 401, a jetting tool (as is commonly known in the art), is used with a liquid and sand to perforate casing 15.

Other examples of the invention will occur to those of skill in the art without departing from the spirit and scope of the invention, which is intended to be defined solely by the claims below and their equivalents. Nothing in the previous portions of this document, the abstract, or the drawings, is intended as a limitation on the scope of the claims below.

The invention claimed is:

1. A method of treatment of a region in a well, the method comprising:

positioning, in a well-bore, a first packer above the region of the well-bore, fixing, below the region, an expansion packer, treating the region, moving, with respect to the first packer and after treating the region, the expansion packer longitudinally in the well, and moving the first packer after the moving of the expansion packer, and wherein the moving of the expansion packer comprises movement of a packer mandrel and a first packer mandrel wherein the first packer mandrel slides within a first packer sleeve.

2. A method as in claim 1 further comprising opening a valve, thereby communicating the region with the portion of the well-bore below the expansion packer, wherein the opening is caused by movement of the packer mandrel.

3. A method as in claim 2, wherein the opening a valve occurs below the expansion packer.

4. A method as in claim 1, wherein the moving the first packer comprises, first, lowering the first packer.

5. A method as in claim 4, wherein the lowering of the first packer comprises, first, lowering the first packer below the treatment region.

6. A method as in claim 4, wherein the moving the first packer comprises raising the first packer after the lowering of the first packer.

7. A method as in claim 4 wherein, during the lowering, fluid pressure in an annulus between the well-bore and the work string is maintained at substantially the same level as just before the lowering or less.

8. A method as in claim 1, further comprising equalizing pressure above and below the expansion packer before the moving of the first packer.

9. A method as in claim 8, wherein the equalizing comprises opening a valve, thereby communicating the region with a portion of the well-bore below the expansion packer.

10. A method as in claim 8, wherein the first packer comprises an expansion packer.

11. A method of treating a well-bore, the method comprising:

positioning a compressible expansion packer in the well-bore, the compressible expansion packer being rigidly-connected to an expansion packer mandrel that is connected to a work string, setting the expansion packer in the well-bore with a longitudinal motion of the work string, after setting, treating the well above the set expansion packer, after treating, opening a valve below the expansion packer with a further longitudinal motion of the work string, and after opening, raising the packer.

12. A method as in claim 11, further comprising positioning a further packer element in the well-bore above the expansion packer, the further packer element being connected to a sleeve that is slideably connected to a further packer mandrel, the further packer mandrel being connected to the work string and the packer mandrel.

13. A method as in claim 12 wherein the further packer comprises a cup element.

14. A method of treating multiple zones in a cased well-bore, the method comprising:

fixing an expansion packer of a work string below a first zone, perforating the cased well-bore above the expansion packer, applying between the work string and the cased well-bore, a stimulation fluid through the perforated well-bore, equalizing the pressure above and below the expansion packer, fixing the expansion packer up at a second zone, the second zone being over the first zone, perforating the cased well-bore above the expansion packer, applying, between the work string and the cased well-bore, a stimulation fluid through the perforated well-bore, equalizing the pressure above and below the expansion packer, and raising the expansion packer, and wherein the equalizing comprises moving a valve port connected to an expansion packer mandrel from contact with a valve seat connected to a drag sleeve.

15. A method as in claim 14 wherein the equalizing comprises opening a valve below the expansion packer.

16. A method of treating a well-bore, the method comprising:

positioning a compressible expansion packer in the well-bore, the compressible expansion packer being rigidly-connected to an expansion packer mandrel that is connected to a work string, setting the expansion packer in the well-bore with a longitudinal motion of the work string, after setting, treating the well, after treating, opening a valve below the expansion packer with a further longitudinal motion of the work string, after opening, raising the packer, and after raising, positioning a further packer element in the well-bore above the expansion packer, the further packer element being connected to a sleeve that is slideably connected to a further packer mandrel disposed radially inward of the further packer, and a shoulder on the further packer mandrel, and a shoulder on the sleeve disposed to stop longitudinal movement of the shoulder on the further packer mandrel, the further packer mandrel being connected to the work string and the packer mandrel.

17. A method as in claim 16 wherein the further packer comprises a cup element.

* * * * *